US005789821A

United States Patent [19]

Shiga et al.

[11] Patent Number: 5,789,821

[45] Date of Patent: *Aug. 4, 1998

[54] STARTER

[75] Inventors: Tsutomu Shiga, Nukata-gun; Nobuyuki Hayashi, Nagoya; Masanori Ohmi, Anjo; Masami Niimi, Handa; Kazuhiro Yamaguchi; Masao Saito, both of Okazaki; Yoshio Murakami, Chita-gun; Takeshi Araki, Nishikasugai-gun, all of Japan

[73] Assignee: Denso Corporation, Kariya, Japan

[ * ] Notice: The term of this patent shall not extend beyond the expiration date of Pat. Nos. 5,508,566 and 5,621,249.

[21] Appl. No.: 788,236

[22] Filed: Jan. 24, 1997

Related U.S. Application Data

[63] Continuation-in-part of Ser. No. 378,004, Jan. 25, 1995, Pat. No. 5,621,249.

[30] Foreign Application Priority Data

| | | | |
|---|---|---|---|
| Sep. 19, 1994 | [JP] | Japan | 2-222322 |
| Feb. 14, 1996 | [JP] | Japan | 8-026549 |
| Apr. 15, 1996 | [JP] | Japan | 8-092095 |
| Jul. 4, 1996 | [JP] | Japan | 8-174817 |

[51] Int. Cl.[6] ..... F02N 11/00

[52] U.S. Cl. ..... 290/38 R; 290/48

[58] Field of Search ..... 290/38 R, 48

[56] References Cited

U.S. PATENT DOCUMENTS

| | | | |
|---|---|---|---|
| 1,349,866 | 8/1920 | Wolffsohn . | |
| 1,941,698 | 1/1934 | Lock | 290/38 |
| 2,141,331 | 12/1938 | Allen | 290/38 |
| 2,233,595 | 3/1941 | Elkin | 290/38 |
| 2,302,325 | 11/1942 | Janes | 290/38 |
| 2,332,086 | 10/1943 | Jones | 290/38 |
| 2,342,632 | 2/1944 | Hood | 290/38 |
| 2,882,421 | 4/1959 | Mendenhall | 290/38 |
| 2,925,810 | 2/1960 | Mendenhall | 123/179 |
| 3,062,966 | 11/1962 | Merriam, Jr. | 290/38 |
| 3,177,368 | 4/1965 | Seilly | 290/38 |
| 3,496,759 | 2/1970 | Buxton | 74/7 |
| 4,855,609 | 8/1989 | Eguchi et al. | 290/48 |
| 4,918,324 | 4/1990 | Isozumi | 290/48 |
| 5,081,874 | 1/1992 | Isozumi | 74/7 A |
| 5,443,553 | 8/1995 | Shiga et al. | 74/74 |
| 5,508,566 | 4/1996 | Nagao et al. | 290/38 R |
| 5,508,577 | 4/1996 | Shiga et al. | 310/201 |
| 5,621,249 | 4/1997 | Shiga et al. | 290/38 R |

FOREIGN PATENT DOCUMENTS

| | | |
|---|---|---|
| 2 552 823 | 4/1985 | France . |
| 2 625 770 | 7/1989 | France . |
| 390972 | 4/1933 | United Kingdom . |
| 614201 | 12/1948 | United Kingdom . |
| 1145737 | 3/1969 | United Kingdom . |

*Primary Examiner*—Steven L. Stephan
*Assistant Examiner*—Nicholas Ponomarenko
*Attorney, Agent, or Firm*—Cushman, Darby and Cushman Intellectual Property Group Pillsbury, Madison & Sutro

[57] ABSTRACT

A starter which reduces the number of parts for a pinion rotation regulation and provides an accurate magnet switch operation. A concave portion is formed on the bottom side of a plunger to store a spherical body set on the rear end of a cord-shaped member, e.g., wire. A male screw and a fixing are used so that the length of the cord-shaped member is adjusted thereby. The length of the string-shaped member is adjusted so that the claw of the pinion rotation regulating member fits into the notch on the outer circumference of a pinion gear. Furthermore, the claw is fit into the notch via the wire when the plunger moves. The cord-shaped member may be replaced by a rod member disposed radially inside or outside the yoke.

19 Claims, 28 Drawing Sheets

STARTER

CROSS REFERENCE TO RELATED APPLICATION

This is a continuation-in-part application of U.S. patent application Ser. No. 08/378,004 filed on Jan. 25, 1995 now U.S. Pat. No. 5,621,249.

BACKGROUND OF THE INVENTION

1. Field of the Invention:

The present invention generally relates to a starter for starting engines.

2. Related Art:

As disclosed in U.K. Patent No. 390,972, the conventional starter conveyed the rotation of a starter motor to a ring gear via a pinion. With this structure, a lever is rotated with movement of a magnet switch plunger and a friction member on the lever is press-fit against the pinion. Using the frictional force of the friction member and pinion, the pinion is advanced with the rotation of a shaft by the motor, and the pinion and ring gear are engaged. In other words, by rotating the lever together with the movement of the magnet switch plunger, the friction member is press-fit with the pinion.

However, with the conventional structure, a link mechanism and lever are used as the mechanism to press-fit the friction member with the pinion. This not only increases the number of parts, but the magnet switch needs to be arranged near the pinion to lay out the link mechanism and lever, by that restricting freedom in the magnet switch layout. Furthermore, if the pinion engages the ring gears and does not return, the plunger does not return to the original position because the brush is directly coupled with the lever and link mechanism. As a result, the plunger movable contact continuously contacts the fixed contact and the motor rotation cannot be stopped.

SUMMARY OF THE INVENTION

In view of the above problem, the present invention has a primary object to simplify the number of component parts and provide an accurate magnet switch operation.

According to a first aspect of the present invention, a pinion is moved to a ring gear side according to the movement of a magnet switch plunger by a pinion movement member via a flexible cord-shaped member used as a connecting member. Therefore, the conventional link mechanism and levers, etc., are not required allowing the number of component parts to be reduced. Furthermore, even if the pinion engages with the ring gear and does not separate from the ring gear, the plunger returns to the original position due to the slackening of the cord-shaped member. Therefore, a movable contact accurately separates from a fixed contract in the magnet switch allowing the electric power to the starter motor to be prevented.

Preferably, a regulating member only needs to be fit to a groove portion on the pinion, so the regulating member can be accurately moved to the pinion side with the cord-shaped member.

More preferably, by using a wire for the cord-shaped member, the durability of coupling can be improved.

Still more preferably, the length of the cord-shaped member can be easily determined by placing an adjustment mechanism between the plunger and the cord-shaped member.

Still more preferably, the length of the cord-shaped member can be easily adjusted by screwing the adjustment member into a hole within the adjustment mechanism.

Still more preferably, by passing the cord-shaped member between a field magnetic pole of the starter motor, a space for laying the cord-shaped member does not need to be separately prepared, and thus, the entire starter is not large. Further, by placing the magnet switch on the axially opposite side of the pinion of the starter motor, the radial direction size of the starter can also be reduced.

According to a second aspect of the present invention, a pinion moving member and a magnet switch are disposed at one and the other axial sides of a motor, respectively, and the moving member is driven by the a plunger of the magnet switch through a link mechanism used as including a lever and a connecting member. The connecting member extends radially outside an armature of the motor and axially through a space between circumferentially arranged fixed magnetic poles.

Preferably, the magnet switch and the motor are so arranged that central axes thereof deviate each other in a radial direction. In a space provided by a deviation of the magnet switch, a battery terminal is disposed.

According to a third aspect of the present invention, there is provided a structure in which a plunger is moved through a rod-type connecting member to actuate a pinion regulating member. The connecting member is constructed to include a moving portion adapted to be moved by the movement of the plunger, an actuating portion for actuating the pinion regulating member, and a rotatable rod-shaped portion for connecting the moving portion and the actuating portion. The rod-shaped portion is arranged radially outside of an armature and extended generally in parallel with a rotary shaft. In order to actuate the pinion regulating member, the rod-shaped portion is turned to move the actuating portion of the lever while abutting against the pinion regulating member in accordance with the turning motion of the rod-shaped portion of the connecting member so that the pinion regulating member is actuated by the movement to regulate the rotation of the pinion. If the pinion regulating member should fail to return from the pinion end face position, the actuating portion of the connecting member can rotate backward according to its rotation by the predetermined extent with its mere abutment against the pinion regulating member. In other words, the rod-shaped portion freely rotates to return the plunger to the initial position so that the movable contact can leave the fixed contact to prevent the malfunction of the magnet switch.

According to a fourth aspect of the present invention, a connecting member for transmitting the drive force of a magnet switch to a pinion gear is arranged through the outside of a yoke of a starter motor. As a result, the connecting member need not be axially extended through inside the inner circumference of the yoke and between adjoining field magnetic poles but may be merely arranged outside of the yoke so that the connecting member can be assembled remarkably easily.

Preferably, the connecting member is arranged in the recess which is formed in the yoke. As a result, the connecting member can be prevented from jumping out from the external diameter of the yoke even if it is arranged outside of the yoke.

According to a fifth aspect of the present invention, there is provided a rod which is constructed to include an actuating portion to come into abutment against a pinion moving member, a rod-shaped intermediate portion, and an actuated portion to come into engagement with a plunger of a magnet switch. The rod thus constructed is so accommodated in a yoke that its intermediate portion extends along the inner circumference of the yoke. The rod is so held as to move within a predetermined range with respect to the yoke so that the drive force of the plunger of the magnet switch is transmitted through the rod to move a pinion moving member. The magnet switch is retained by the rear end portion (as opposed to the housing) of a motor or a rear cover, and its front area (or the area projected on a plane normal to a pinion drive shaft) is suppressed approximately to the sectional area of the motor. The rod is adopted as the connecting member for transmitting the drive force of the plunger to the pinion moving member thereby to prevent the malfunction which might otherwise be easily caused by the coming-out of a cord-shaped member.

DETAILED DESCRIPTION OF THE PRESENTLY PREFERRED EMBODIMENTS

Figure 1:
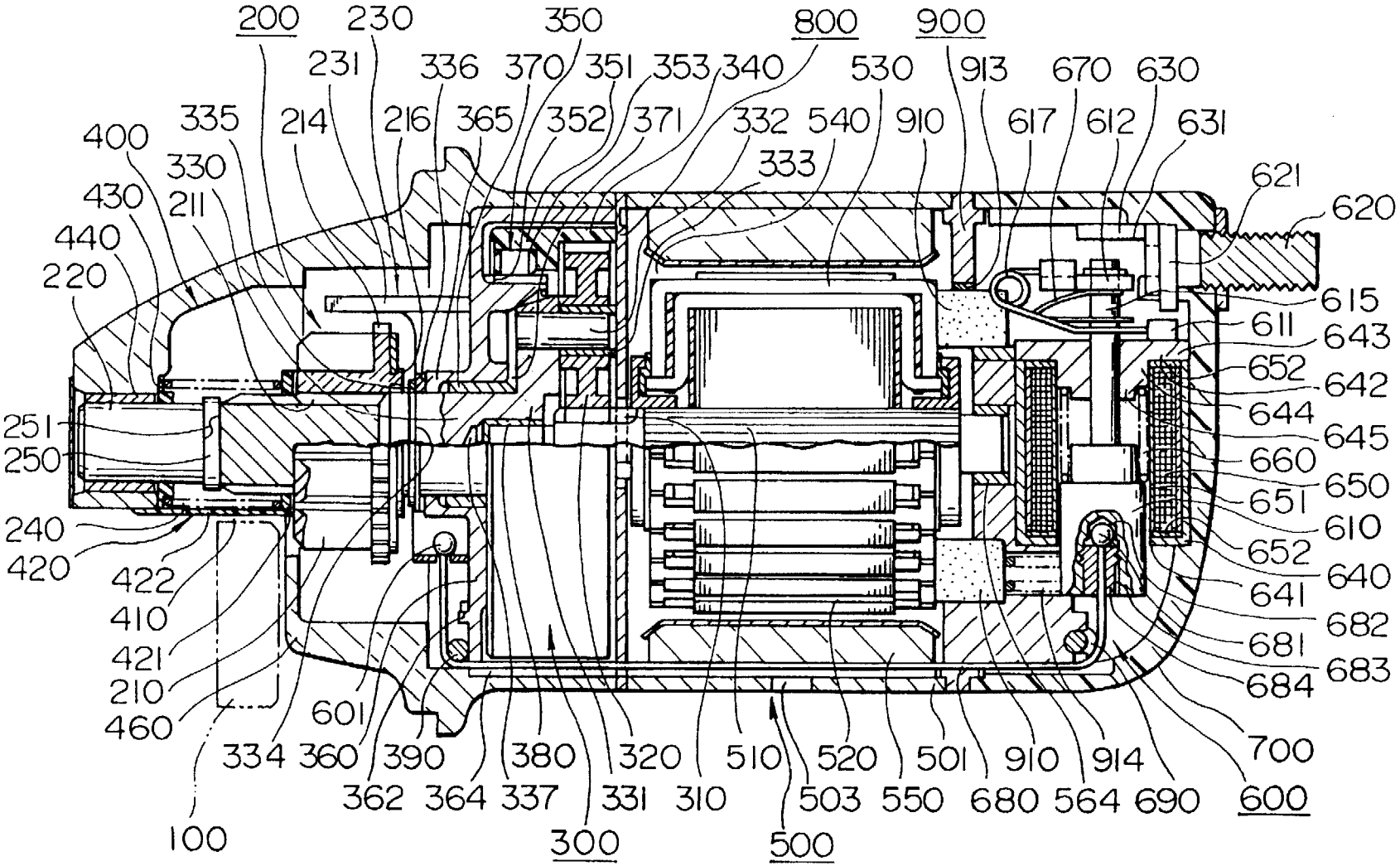
FIG. 1 is a sectional side view showing the first embodiment of a starter of the present invention.

Next, the starter of this invention will be described with reference to various embodiments shown in the accompanying drawings, in which the same reference numerals are used to denote the same or similar parts in construction or function.

[FIRST EMBODIMENT]

A starter according to the first embodiment shown in FIGS. 1 to 15A–15C can be generally divided into a housing 400 containing a pinion 200 which meshes with a ring gear 100 mounted on an engine (not shown) and a planetary gear speed reduction mechanism 300, a motor 500, and an end frame 700 containing a magnet switch 600. Inside the starter, the housing 400 and the motor 500 are separated by a motor spacer wall 800, and the motor 500 and the end frame 700 are separated by a brush holding member 900.

(Pinion 200)

Figure 3A:
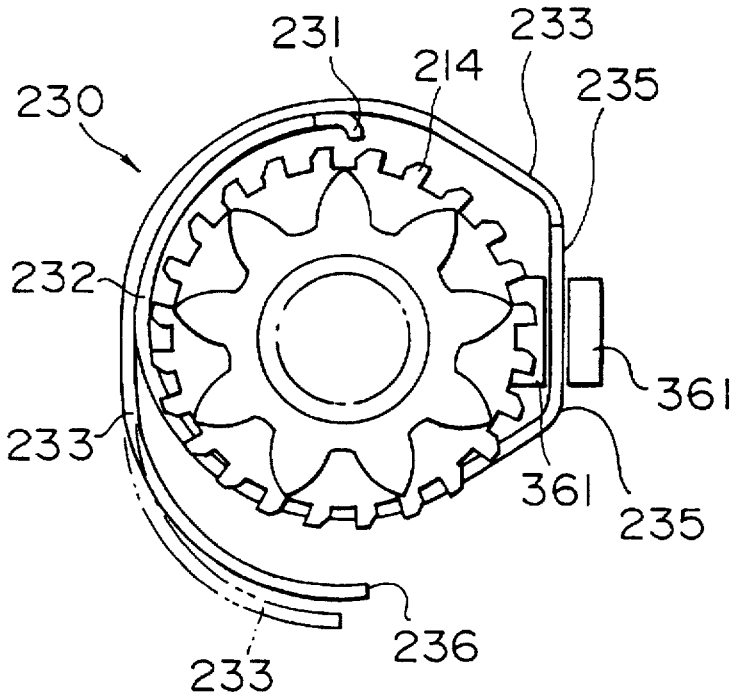
FIGS. 3A and 3B are a front view and a partial sectional side view of a pinion rotation regulating member fitted to a pinion part.
Figure 3B:
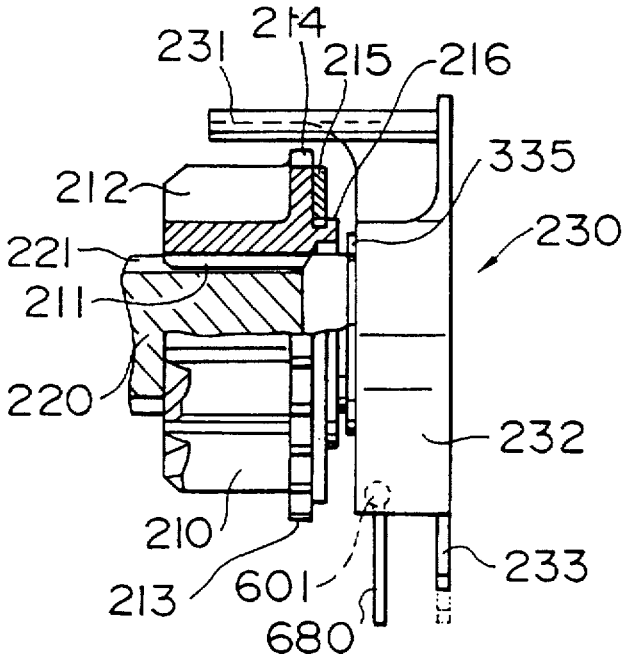

As shown in FIG. 1 and further in detail in FIGS. 3A and 3B, a pinion gear 210 which meshes with the ring gear 100 of the engine is formed on the pinion 200.

A pinion helical spline 211 which mates with a helical spline 221 formed on an output shaft 220 is formed around the inner surface of the pinion gear 210.

On the opposite side of the pinion gear 210 from the ring gear 100 a flange 213 of greater diameter than the external diameter dimension of the pinion gear 210 is formed in circular form. A number of projections 214 greater than the number of outer teeth of the pinion gear 210 are formed around the entire outer circumference of this flange 213. These projections 214 are for a regulating claw 231 of a pinion rotation regulating member 230 which will be discussed later to mate with. A washer 215 is bent onto the outer peripheral side of an annular portion 216 formed on the rear end of the pinion gear 210 and thereby disposed rotatably and unable to come off in the axial direction on the rear surface of the flange 213.

By the rotatable washer 215 being mounted on the rear surface of the flange 213 of the pinion gear 210 in this way, when a pinion rotation regulating member 230 which will be discussed later drops in behind the pinion gear 210, the front end of a regulating claw 231 of the pinion rotation regulating member 230 abuts with the washer 215. As a result, the rotation of the pinion gear 210 does not directly abut with the regulating claw 231 of the pinion rotation regulating member 230, and the washer 215 rotates relatively and the pinion gear 210 is prevented from being worn by the regulating claw 231 of the pinion rotation regulating member 230.

The pinion gear 210 is urged toward the rear of the output shaft 220 at all times by a return spring 240 consisting of a compression coil spring. The return spring 240 not only urges the pinion gear 210 directly but in this embodiment urges the pinion gear 210 by way of a ring body 421 of a shutter 420 which opens and closes an opening portion 410 of the housing 400 and will be further discussed later.

(Pinion Rotation Regulating Member 230)

Figure 2:
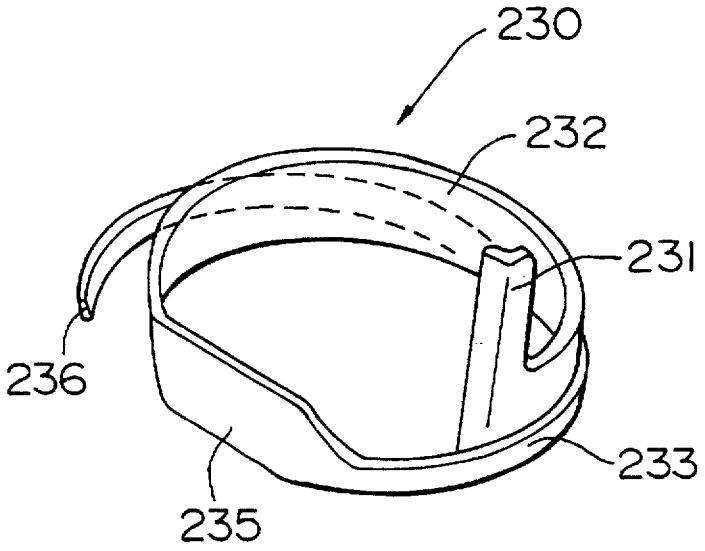
FIG. 2 is a perspective view of a pinion rotation regulating member.

The pinion rotation regulating member 230 constituting pinion moving means, as shown in FIG. 2 and FIGS. 3A and 3B in detail, is a sheet spring member wound through approximately ½ (i.e., 1.5) turns of which approximately ¾ turns is a rotation regulating portion 232 of long axial sheet length and high spring constant and the remaining approximately ¾ turns is a return spring portion 233 constituting urging means of short axial sheet length and low spring constant.

A regulating claw 231 which constitutes a regulating portion extending in the axial direction and which mates with the multiple projections 214 formed in the flange 213 of the pinion gear 210 is formed at one end of the rotation regulating portion 232. This regulating claw 231, as well as mating with the projections 214 of the pinion gear 210, in order to increase the rigidity of the regulating claw 231, is formed axially long and is bent radially inward into a cross-sectional L-shape and is bar-like.

The rotation regulating portion 232 is provided with a straight portion 235 which extends vertically. This straight portion 235 is vertically slidably supported by two supporting arms 361 mounted projecting from the front surface of a center bracket 360. That is, the straight portion 235 moving vertically causes the rotation regulating portion 232 to move vertically also.

Also, a sphere 601 of the front end of a cord-shaped member 680 (for example a wire), which will be further discussed later, for transmitting the movement of the magnet switch 600, which will be further discussed later, is in engagement with the position 180° opposite the regulating claw 231 of the rotation regulating portion 232.

The end portion side of the return spring portion 233 has a large radius of curvature and one end portion 236 of the return spring portion 233 abuts with the upper surface of a regulating shelf 362 mounted projecting from a front surface of a lower portion of the center bracket 360.

The operation of the pinion rotation regulating member 230 will now be explained. The cord-shaped member 680 is transmitting means for transmitting the movement of the magnet switch 600 to the regulating claw 231, and the movement of the magnet switch 600 pulls the rotation regulating portion 232 downward and causes the regulating claw 231 to engage with the projections 214 on the flange 213 of the pinion gear 210. At that time, because the end portion 236 of the return spring portion 233 is in abutment with the regulating shelf 362 for position regulating, the return spring portion 233 bends. Because the regulating claw 231 is in engagement with the projections 214 on the pinion gear 210, when the pinion gear 210 starts to be rotated by way of the armature shaft 510 of the motor 500 and the planetary gear speed reduction mechanism 300, the pinion gear 210 advances along the helical spline 221 on the output shaft 220. When the pinion gear 210 abuts with the ring gear 100 and the advance of the pinion gear 210 is obstructed, further rotational force of the output shaft 210 causes the pinion rotation regulating member 230 itself to bend and the pinion gear 210 rotates slightly and meshes with the ring gear 100. When the pinion gear 210 advances, the regulating claw 231 disengages from the projections 214, the regulating claw 231 drops in behind the flange 213 of the pinion gear 210, the front end of the regulating claw 231 abuts with the rear surface of the washer 215 and prevents the pinion gear 210 from retreating under the rotation of the ring gear 100 of the engine.

As the movement of the magnet switch 600 stops and the cord-shaped member 680 stops pulling the rotation regulating portion 232 downward, the action of the return spring portion 233 causes the rotation regulating portion 232 to return to its original position.

In this way, the pinion rotation regulating member 230, although it is one spring member, performs the three operations that are the operation of regulating the rotation of the pinion gear 210 and advancing the pinion gear 210, the operation of dropping in behind the pinion gear 210 and preventing the pinion gear 210 from retracting, and the operation of returning the rotation regulating portion 232. That is, because a plurality of operations are carried out by one part, the number of parts in the starter can be reduced and the assemblability can be improved.

Also, when the pinion rotation regulating member 230 abuts with the pinion gear 210 and by means of the rotation of the output shaft 220, while moving the pinion gear 210 to the ring gear 100 side, the pinion gear 210 abuts with the ring gear 100, because the pinion rotation regulating member 230 itself bends and rotates the pinion gear 210 slightly and causes it to mesh with the ring gear, there is no production of abrasion powder and there are few parts and the construction can be made simple.

Also, the pinion rotation regulating member 230, because the projecting parts of the projections 214 of the pinion gear 210 are more numerous than the teeth of the pinion gear 210, can easily engage with the projections 214.

Because the pinion rotation regulating member 230 need only be held with the small force required to regulate the rotation of the pinion gear 210, it is possible to move it to the pinion gear 210 side by means of the magnet switch 600, using the cord-shaped member 680, and consequently it is possible to increase the freedom with which the magnet switch 600 is disposed.

Also, the pinion rotation regulating member 230 itself can prevent the pinion gear 210 from returning when the pinion gear 210 has meshed with the ring gear 100, and the number of parts can be made small and the assembly can be simplified.

Furthermore, because the pinion rotation regulating member 230 itself integrally comprises the return spring portion 233 constituting urging means urging to the opposite side to the pinion gear, by switching the magnet switch 600 OFF, the pinion rotation regulating member 230 automatically moves away from the pinion gear 210 and the number of parts can be made small and the assembly can be simplified.

By part of the pinion rotation regulating member 230 having the regulating claw 231 constituting the bar-like resilient regulating portion, the pinion rotation regulating member itself can reliably bend.

Also, by the washer 215 being rotatably held on the end surface of the pinion gear 210, even when the pinion gear 210 is over-run by the ring gear 100 and rotates at high speed, because the washer 215 is rotatable with respect to the pinion gear 210, the abutting portion of the regulating claw 231 constituting the regulating portion is not worn much, and the durability can be increased.

(Pinion Stopping Ring 250)

The pinion stopping ring 250 is fixed in a circular groove of rectangular cross-section formed around the output shaft 220. This pinion stopping ring 250 is a piece of steel of rectangular cross-section processed into a circular shape; a substantially S-shaped corrugation 251 (an example of engaging means) is formed at each end, and the convex portion of one is in engagement with the concave portion of the other and the convex portion of the other is in engagement with the concave portion of the first.

(Planetary Gear Speed Reduction Mechanism 300)

The planetary gear speed reduction mechanism 300, as shown in FIG. 1, is speed reducing means for reducing the rotational speed of the output shaft 220 relative to motor 500, which will be further discussed later, and increasing the output torque of the motor 500. The planetary gear speed reduction mechanism 300 is made up of a sun gear 310 formed on the front-side outer periphery of the armature shaft 510 (discussed later) of the motor 500, a plurality of planetary gears 320 which mesh with this sun gear 310 and rotate around the circumference of the sun gear 310, a planet carrier 330 which rotatably supports these planetary gears 320 around the sun gear 310 and is formed integrally with the output shaft 220, and an internal gear 340 which is of a cylindrical shape meshing with the planetary gears 320 at the outer periphery of the planetary gears 320 and is made of resin.

(Overrunning Clutch 350)

The overrunning clutch 350 supports the internal gear 340 rotatably in one direction only (only the direction in which it rotates under the rotation of the engine). The overrunning clutch 350 has a clutch outer 351 constituting a first cylindrical portion integrally formed in the front side of the internal gear 340, a circular clutch inner 352 constituting a second cylindrical portion formed in the rear surface of the center bracket 360 constituting a fixed side covering the front of the planetary gear speed reduction mechanism 300 and disposed facing the clutch outer 351, and a roller 353 accommodated in a roller housing portion formed inclined to the inner surface of the clutch outer 351.

(Center Bracket 360)

Figure 4:
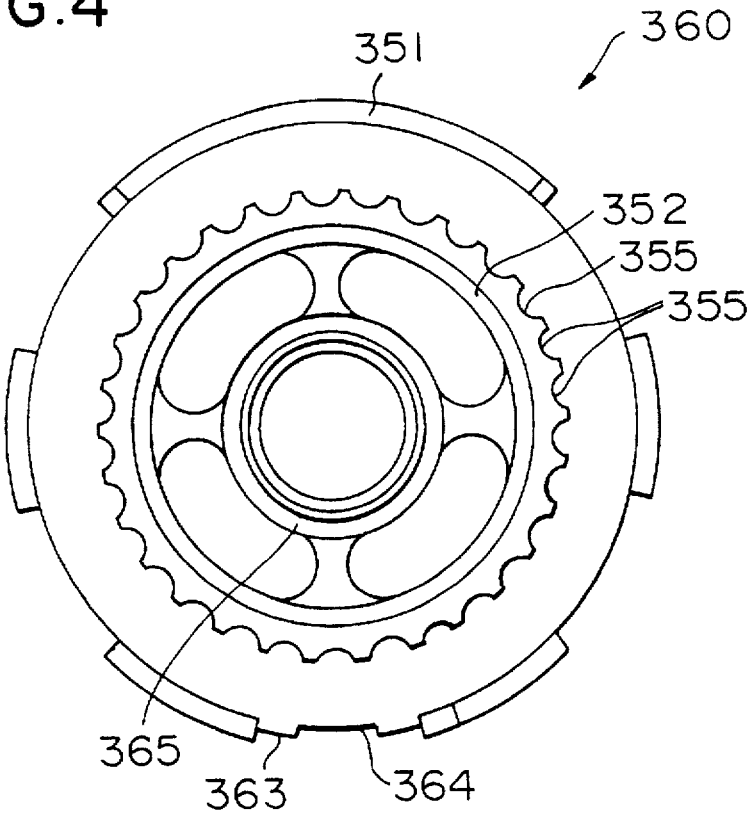
FIG. 4 is a rear view of a center bracket.
Figure 5:
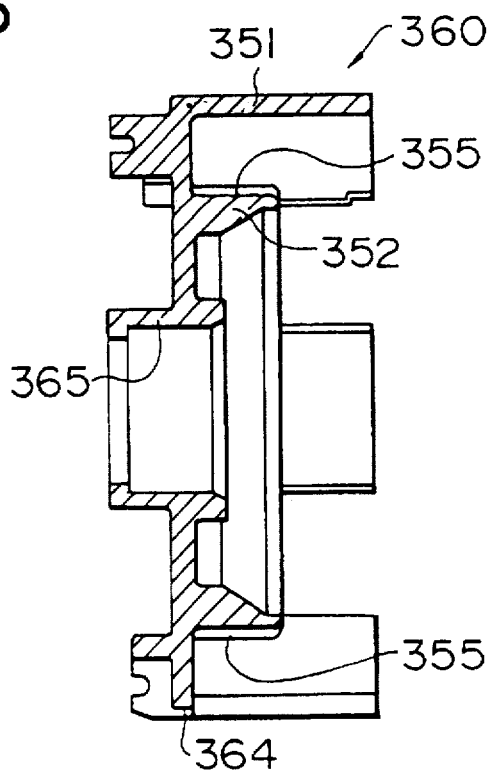
FIG. 5 is a sectional side view of a center bracket.
Figure 6:
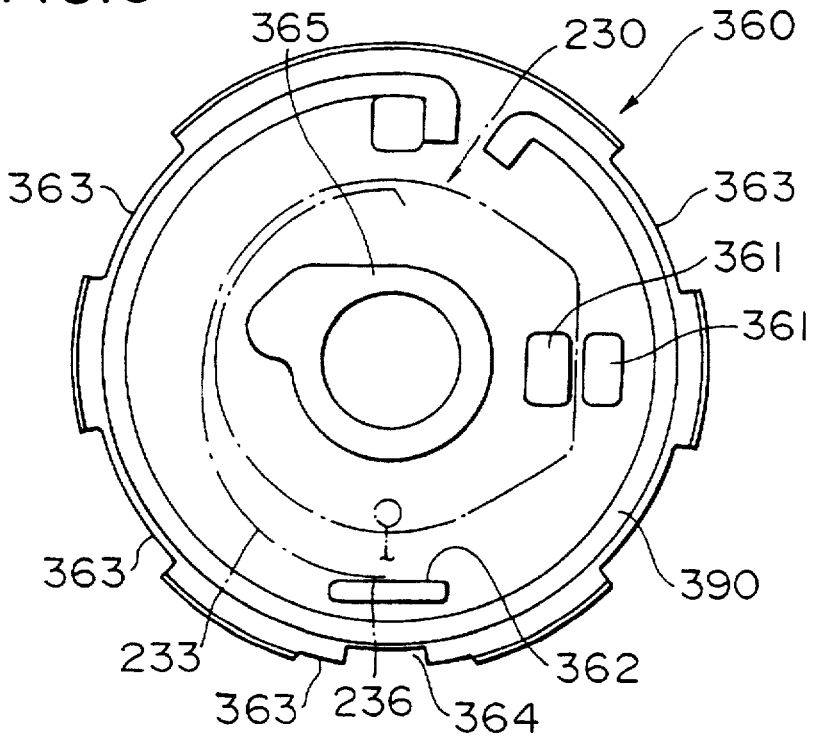
FIG. 6 is a front view of a center bracket.

The center bracket 360 is shown in detail in FIG. 4 through FIG. 6 and is disposed inside the rear end of the housing 400. The housing 400 and the center bracket 360 are linked by a ring spring 390 having one end engaged with the housing 400 and the other end engaged with the center bracket 360 and are arranged in such a way that the rotational reaction received by a clutch inner 352 constituting the overrunning clutch 350 is absorbed by the ring spring 390 and the reaction is not directly transmitted to the housing 400.

Also, two supporting arms 361 which hold the pinion rotation regulating member 230 and a regulating shelf 362 on which the lower end of the pinion rotation regulating member 230 is loaded are mounted on the front surface of the center bracket 360. Further, a plurality of cutout portions 363 which mate with convex portions (not shown in the drawings) on the inner side of the housing 400 are formed around the center bracket 360. The upper side cutout portions 363 are used also as air passages for guiding air from inside the housing 400 into a yoke 501. Also, a concave portion 364 through which the cord-shaped member 680 (discussed later) passes in the axial direction is formed at the lower end of the center bracket 360.

(Planet Carrier 330)

The planet carrier 330 is provided at its rear end with a flange-like projecting portion 331 which extends radially in order to support the planetary gears 320. Pins 332 extending rearward are fixed to this flange-like projecting portion 331, and these pins 332 rotatably support the planetary gears 320 by way of metal bearings 333.

The planet carrier 330 has its front end rotatably supported by a housing bearing 440 fixed inside the front end of the housing 400 and a center bracket bearing 370 fixed inside an inner cylindrical portion 365 of the center bracket 360.

(Housing 400)

The housing 400 supports the output shaft 220 with the housing bearing 440 fixed in the front end of the housing 400 and also is provided with a water barrier wall 460 which in order to minimize the incursion of rainwater and the like through the opening portion 410 minimizes the gap at the lower part of the opening portion 410 between the outer diameter of the pinion gear 210 and the housing 400. Also, two slide grooves extending axially are provided at the lower part of the front end of the housing 400, and a shutter 420 which will be further discussed later is disposed in these slide grooves.

(Shutter 420)

The shutter 420 consisting of a resinous member (for example nylon) is mounted on the output shaft 220 and comprises a ring body 421 sandwiched between the return spring 240 and the pinion gear 210 and a water-barrier portion 422 which opens and closes an opening portion 410 in the housing 400. The operation of the shutter 420 is such that when the starter starts to operate and the pinion gear 210 shifts forward along the output shaft 220 the ring body 421 shifts forward together with the pinion gear 210. When this happens, the water-barrier portion 422 integral with the ring body 421 shifts forward and opens the opening portion 410 of the housing 400. When the starter stops operating and the pinion gear 210 shifts backward along the output shaft 220, the ring body 421 also shifts backward together with the pinion gear 210. When this happens, the water-barrier portion 422 integral with the ring body 421 also shifts backward and closes the opening portion 410 of the housing 400. As a result, the shutter 420, which constitutes opening and closing means, by means of the water-barrier portion 422 prevents rainwater and the like which is splashed by the centrifugal force of the ring gear 100 from getting inside the housing 400 when the starter is not operating.

(Motor 500)

The motor 500 is enclosed by a yoke 501 having a through hole 503, motor spacer wall 800, and a brush holding member 900 which will be discussed later. The motor spacer wall 800 houses the planetary gear speed reduction mechanism 300 between itself and the center bracket 360, and also fulfills the role of preventing lubricating oil inside the planetary gear speed reduction mechanism 300 from getting into the motor 500.

The motor 500, as shown in FIG. 1, is made up of an armature 540 comprising the armature shaft 510 and an armature core 520 and armature coils 530 which are mounted on and rotate integrally with this armature shaft 510, and fixed poles 550 which rotate the armature 540, and the fixed poles 550 are mounted around the inside of the yoke 501.

(Armature Coils 530)

Figure 7:
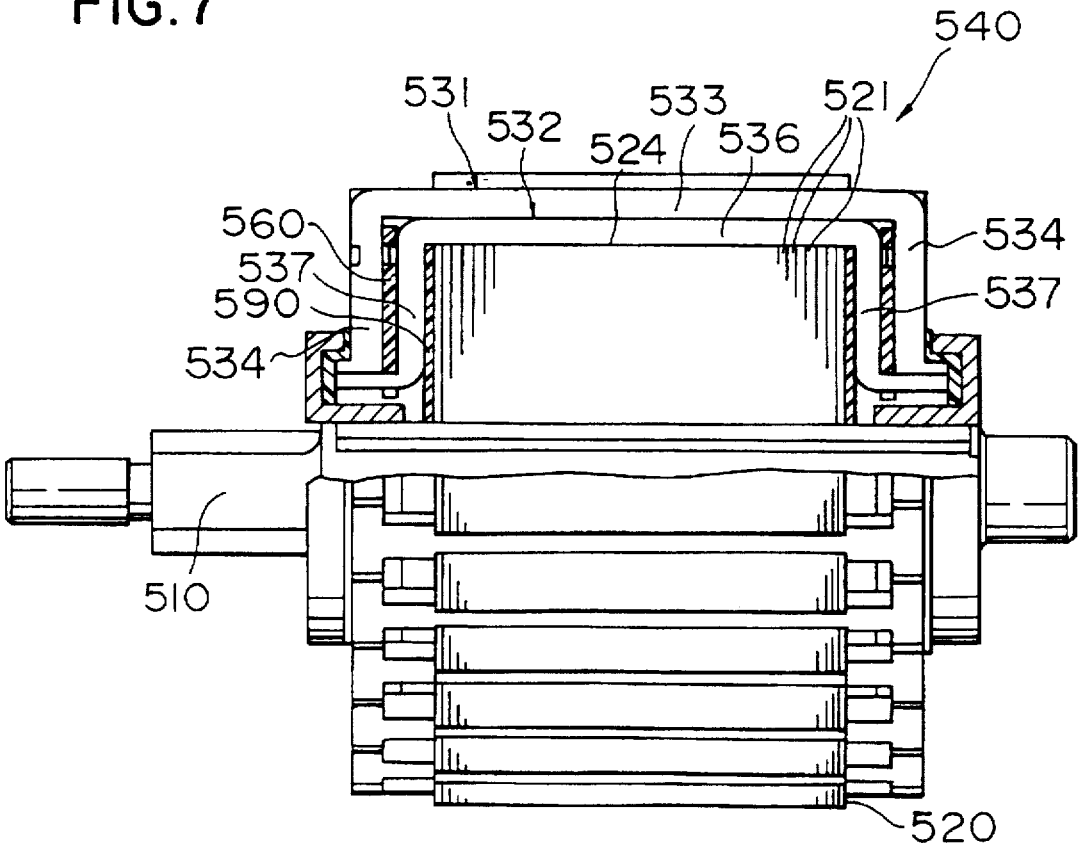
FIG. 7 is a sectional side view of an armature.

For the armature coils 530, in this embodiment shown in detail in FIG. 7, multiple (for example 25) upper layer coil bars 531 and the same number of lower layer coil bars 532 as these upper layer coil bars 531 are used, and 2-layer-winding coils wherein the respective upper layer coil bars 531 and the lower layer coil bars 532 are stacked in the radial direction are employed. The upper layer coil bars 531 and lower layer coil bars 532 are paired, and the ends of the upper layer coil bars 531 and the ends of the lower layer coil bars 532 are electrically connected to constitute ring-shaped coils.

(Upper Layer Coil Bars 531)

The upper layer coil bars 531, as shown in FIG. 7, are made of a material having excellent electrical conductivity (for example copper), and are each provided with an upper layer coil arm 533 which extends axially in parallel with the fixed poles 550 and is held in the outer sides of slots 524 and two upper layer coil ends 534 which are bent inward from both ends of the upper layer coil arm 533 and extend in a direction orthogonal to the axial direction of the armature shaft 510. The upper layer coil arm 533 and the two upper layer coil ends 534 may be a member integrally molded by cold casting, may be a member shaped by bending in a press into a U-shape, or may be a member formed by joining an upper layer coil arm 533 and two upper layer coil ends 534 made as separate parts by a joining method such as welding.

(Lower Layer Coil Bars 532)

The lower coil bars 532, like the upper coil bars 531, are made from a material having excellent electrical conductivity (for example copper), and each comprise a lower layer coil arm 536 which extends axially in parallel with respect to the fixed poles 550 and is held in the inner sides of slots 524 and two lower layer coil ends 537 which are bent inward from the ends of this lower layer coil arm 536 and extend orthogonal to the axial direction of the armature shaft 510. The lower layer coil arm 536 and the two lower layer coil ends 537, like the upper layer coil bar 531, may be a member integrally molded by cold casting, may be a member shaped by bending in a press into a U-shape, or may be a member formed by joining a lower layer coil arm 536 and 2 lower layer coil ends 537 made as separate parts by a joining method such as welding.

Insulation between the upper layer coil ends 534 and the lower layer coil ends 537 is secured by insulating spacers 560, and insulation between the lower layer coil ends 537 and the armature core 520 is secured by an insulating ring 590 made of resin (for example nylon or phenol resin).

(Yoke 501)

Figure 8:
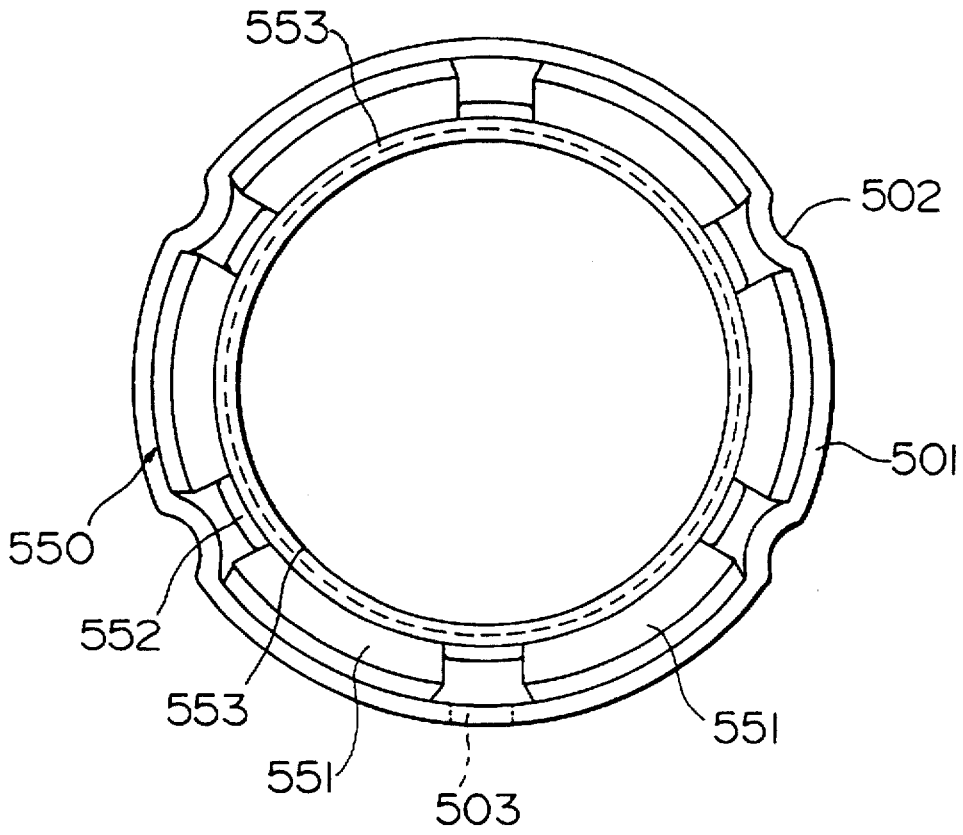
FIG. 8 is a front view of a yoke.

The yoke 501, as shown in FIG. 8, is a cylindrical body formed by rolling a steel plate, and around it are formed a plurality of concave grooves 502 extending axially and sunk toward the inner circumference. These concave grooves 502, as well as disposing through bolts, are used for positioning fixed poles 550 around the inner circumference of the yoke 501.

(Fixed Poles 550)

In this embodiment permanent magnets are used for the fixed poles 550 and, as shown in FIG. 8, they comprise a plurality of (for example 6) main poles 551 and inter-pole poles 552 disposed between these main poles 551. Field coils which generate magnetic force by electrical current flow may be used instead of permanent magnets for the fixed poles 550.

The main poles 551 are positioned by the ends of the inner sides of channel grooves 502 in the above-mentioned yoke 501, and are fixed in the yoke 501 by fixing sleeves 553 disposed around the inside of the fixed poles 550 with the inter-pole poles 552 disposed between the main poles 551.

(Magnet Switch 600)

Figure 9:
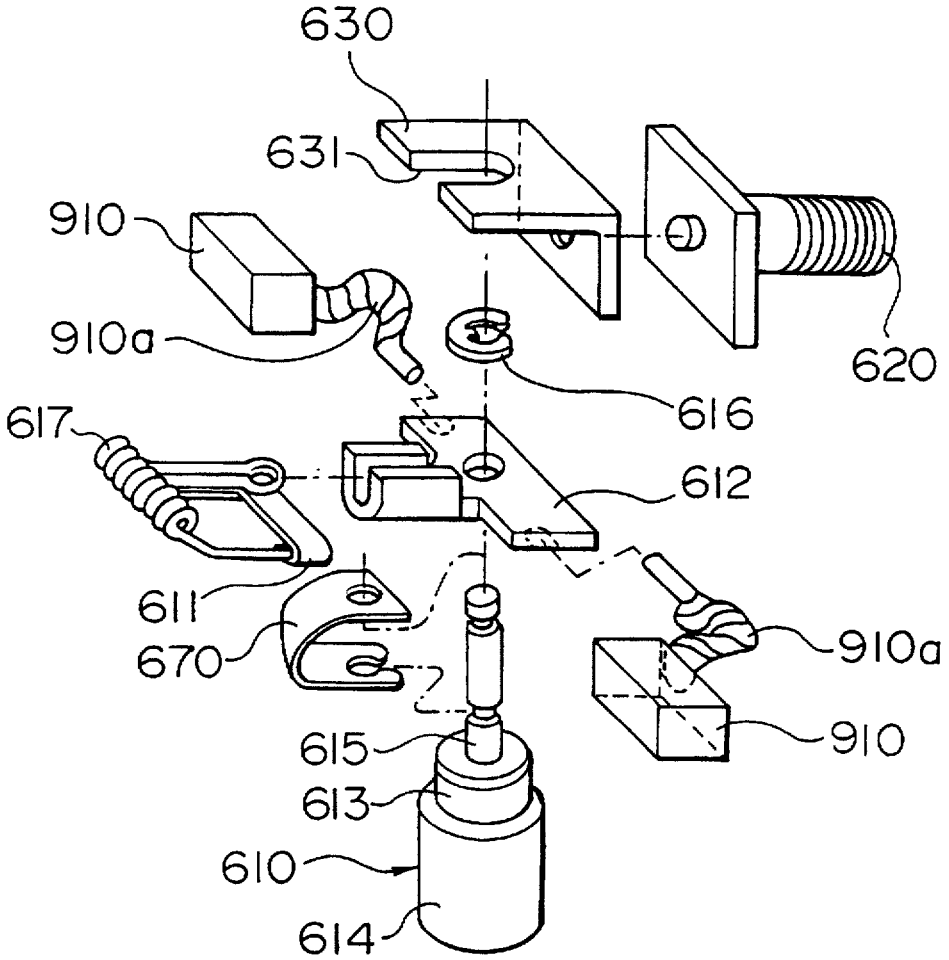
FIG. 9 is an exploded perspective view of a plunger and contact points of a magnet switch.
Figure 10:
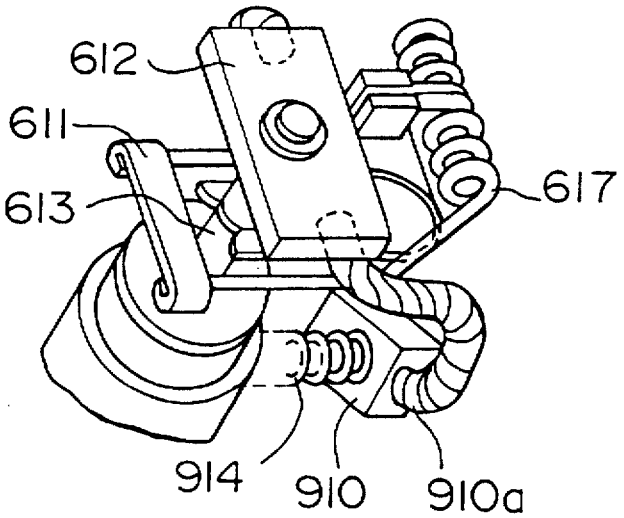
FIG. 10 is a perspective view showing a plunger of a magnet switch.

The magnet switch 600, as shown in FIG. 1, FIG. 9 and FIG. 10, is held in a brush holder 900 which will be discussed later, is disposed inside an end frame 700 which will be discussed later, and is fixed so as to be substantially orthogonal to the armature shaft 510.

In the magnet switch 600, electrical current drives a plunger 610 upward, and two contacts (a lower movable contact 611 and an upper movable contact 612) which move together with the plunger 610 are sequentially caused to abut with the head portion 621 of a terminal bolt 620 and an abutting portion 631 of a fixed contact 630. A battery cable not shown in the drawings is connected to the terminal bolt 620.

The magnet switch 600 is structured inside a magnet switch cover 640 which is cylindrical and has a bottom and is made from magnetic parts (for example made of iron). The magnet switch cover 640 is for example a pliable steel plate press-formed into a cup shape, and in the center of the bottom of the magnet switch cover 640 there is a hole 641 through which the plunger 610 passes movably in the vertical direction. Also, the upper opening of the magnet switch cover 640 is closed off by a stationary core 642 made of a magnetic body (for example made of iron).

The stationary core 642 consists of an upper large diameter portion 643, a lower middle diameter portion 644, and a still lower small diameter portion 645, and the stationary core 642 is fixed in the upper opening of the magnet switch cover 640 by the outer periphery of the large diameter portion 643 being caulked to the inner side of the upper end of the magnet switch cover 640. The upper end of an attracting coil 650 is fitted around the middle diameter portion 644. The upper end of a compression coil spring 660 which urges the plunger 610 downward is fitted around the periphery of the small diameter portion 645 of the stationary core 642.

The attracting coil 650 is attracting means which generates magnetism when a current flows through it and attracts the plunger 610, and the attracting coil 650 is provided with a sleeve 651 which has its upper end fitted to the middle diameter portion 644 of the stationary core 642 and covers the plunger 610 slidably in the vertical direction. This sleeve 651 is made by rolling up a non-magnetic thin plate (for example copper plate, brass, stainless steel), and insulating washers 652 made of resin or the like are provided at the upper and lower ends of this sleeve 651. Around the sleeve 651 between these 2 insulating washers 652 there is wound a thin insulating film (not shown in the drawings) made of resin (for example cellophane, nylon film) or paper, and around that insulating film is wound a predetermined number of turns of a thin enamel wire, whereby the attracting coil 650 is constituted.

The plunger 610 is made of a magnetic metal (for example iron) and has a substantially cylindrical shape comprising an upper small diameter portion 613 and a lower large diameter portion 614. The lower end of the compression coil spring 660 is fitted to the small diameter portion 613, and the large diameter portion 614, which is relatively long in the axial direction, is held slidably vertically in the sleeve 651.

A plunger shaft 615 extending upward from the plunger 610 is fixed to the upper end of the plunger 610. This plunger shaft 615 projects upward through a through hole provided in the stationary core 642. An upper movable contact 612 is fitted around the plunger shaft 615 above the stationary core 642 slidably vertically along the plunger shaft 615. This upper movable contact 612, as shown in FIG. 9, is limited by a stopping ring 616 fitted to the upper end of the plunger shaft 615 so that it does not move upward of the upper end of the plunger shaft 615. As a result, the upper movable contact 612 is vertically slidable along the plunger shaft 615 between the stopping ring 616 and the stationary core 642. The upper movable contact 612 is urged upward at all times by a contact pressure spring 670 consisting of a sheet plate spring fitted to the plunger shaft 615.

The upper movable contact 612 is made of a metal such as copper having excellent conductivity, and when both ends of the upper movable contact 612 move upward they abut with the two abutting portions 631 of the fixed contact 630. The lead wires 911 of a pair of brushes 910 are electrically and mechanically fixed to the upper movable contact 612 by caulking or welding or the like. Also, the end portion of a resistor member 617 constituting a plurality of (in this embodiment, two) limiting means is inserted and electrically and mechanically fixed in a groove portion of the upper movable contact 612.

The lead wires 911 are electrically and mechanically fixed to the upper movable contact 612 by caulking or welding, but the upper movable contact 612 and the lead wires 911 of the brushes 910 may alternatively be formed integrally.

The resistor member 617 is for rotating the motor 500 at low speed when the starter starts to operate, and consists of a metal wire of high resistance wound through several turns. A lower movable contact 611 located below the head portion 621 of the terminal bolt 620 is fixed by caulking or the like to the other end of the resistor member 617.

The lower movable contact 611 is made of a metal such as copper having excellent conductivity, and when the magnet switch 600 stops and the plunger 610 is in its downward position abuts with the upper surface of the stationary core 642, when the resistor member 617 moves upward along with the movement of the plunger shaft 615, before the upper movable contact 612 abuts with the abutting portion 631 of the fixed contact 630 it abuts with the head portion 621 of the terminal bolt 620.

The lower surface of the plunger 610 is provided with a recess portion 682 which accommodates a sphere 681 provided at the rear end of the cord-shaped member 680 (for example a wire). A female thread 683 is formed on the inner wall of this female thread 683. A fixing screw 684 which fixes the sphere 681 in the recess portion 682 is screwed into this recess portion 682. This fixing screw 684 is also used to perform adjustment of the length of the cord-shaped member 680, by adjusting the extent to which the fixing screw 684 is screwed into the female thread 683. The length of the cord-shaped member 680 is adjusted so that when the plunger shaft 615 moves upward and the lower movable contact 611 abuts with the terminal bolt 620 the regulating claw 231 of the pinion rotation regulating member 230 mates with the projections 214 of the outer periphery of the pinion gear 210. The female thread 683 and the fixing screw 684 constitute an adjusting mechanism.

With such a construction, because with respect to the movement of the plunger 610 of the magnet switch 600, via the cord-shaped member 680, the pinion rotation regulating member 230 is moved to the pinion gear 210 side, conventional link mechanisms and levers and the like are not necessary and the number of parts can be reduced, and also even if the pinion gear 210 fails to move away from the ring gear 100, bending in the cord-shaped member 680 itself causes the plunger 610 to return to its original position, and the upper movable contact 612 can move away from the fixed contact 630.

Also, because all that is necessary is to cause the regulating claw 231 of the pinion rotation regulating member 230 to engage with the projections 214 on the pinion gear 210, this regulating claw 231 can be reliably moved by the cord-shaped member 680.

By making the cord-shaped member 680 a wire, the durability can be increased.

Also, by disposing the adjusting mechanism consisting of the female thread 683 and the fixing screw 684 between the plunger 610 and the cord-shaped member 680 and screwing the fixing screw 684 into the female thread 683, the length of the cord-shaped member 680 can be easily adjusted.

Also, because the lead wires **910*a* of the brushes 910 are directly connected to the upper movable contact 612, heat generated at the brushes 910 is efficiently radiated via the lead wires 910*a*, the upper movable contact 612 and the terminal bolt 620 from the battery cable connected to the terminal bolt 620 and positioned outside the starter, and increases in the life of the brushes 910** can be attempted.

Furthermore, because the plunger shaft 615 of the magnet switch 600 is disposed substantially orthogonal to the motor axis, compared to a case wherein the plunger shaft 615 of the magnet switch 600 is disposed axially, the axial direction dimension of the starter can be shortened and the stroke through which the plunger shaft 615 is required to pull the cord-shaped member 680 can be set small, and further downsizing of the magnet switch 600 can be attempted.

Furthermore, because the plunger 615 of the magnet switch 600 is disposed orthogonal with respect to the axial direction of the armature shaft 510, only the diametral direction length of the magnet switch 600 adds to the axial direction length of the overall starter, and the build of the whole starter is not made large.

Furthermore, because the magnet switch 600 is housed inside the end frame 700, it does not readily suffer damage from water and the like which has entered through the opening 410 in the housing 400.

(End Frame 700)

Figure 11:
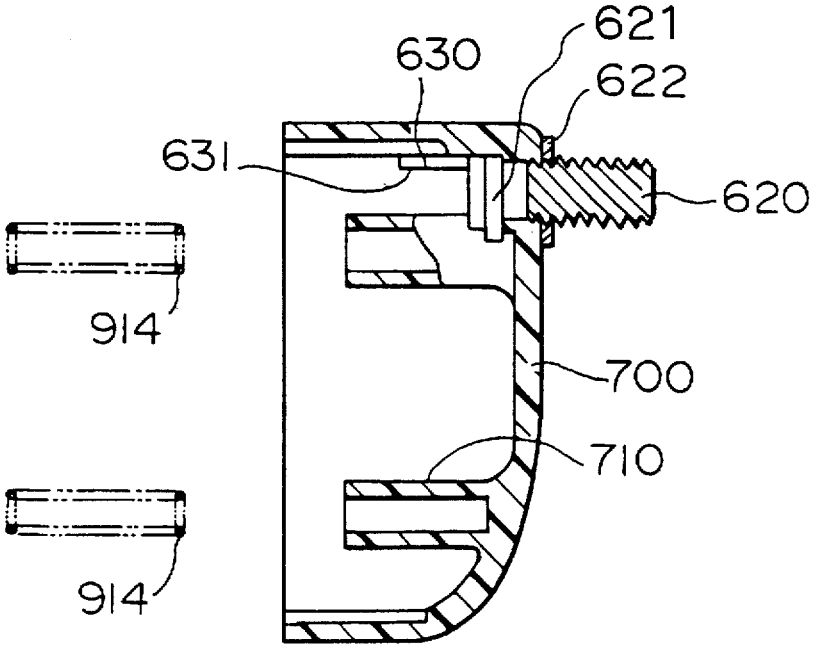
FIG. 11 is a sectional view of an end frame and a brush spring.

The end frame 700, as shown in FIG. 11, is a magnet switch cover made of resin (for example phenol resin), and accommodates the magnet switch 600.

Spring holding pillars 710 which hold compression coil springs 914 which urge the brushes 910 forward are mounted projecting from the rear surface of the end frame 700 in correspondence with the positions of the brushes 910.

Also, the compression coil springs 914, as shown in FIG. 1, are disposed radially outward with respect to the axial direction of the plunger 610 of the magnet switch 600.

The terminal bolt 620 is a steel bolt which passes through the end frame 700 from the inside and projects from the rear of the end frame 700 and has at its front end a head portion 621 which abuts with the inner surface of the end frame 700. The terminal bolt 620 is fixed to the end frame 700 by a caulking washer 622 being attached to the terminal bolt 620 projecting rearward of the end frame 700. A copper fixed contact 630 is fixed to the front end of the terminal bolt 620 by caulking. The fixed contact 630 has one or a plurality of (in this embodiment, two) abutting portions 631 positioned at the top end of the inside of the end frame 700, and these abutting portions 631 are mounted so that the upper surface of the upper movable contact 612 which is moved up and down by the operation of the magnet switch 600 can abut with the lower surfaces of the abutting portions 631.

Further, the spring length of the compression coil springs 914 can use the radial direction length of the magnet switch 600, a suitable spring stress and load can be set, and the life of the compression coil springs 914 can be greatly increased.

(Brush Holder 900)

The brush holder 900, as well as the roles of separating the inside of the yoke 501 and the inside of the end frame 700 and rotatably supporting the rear end of the armature shaft 510 by way of the brush holder bearing 564, also fulfills the role of a brush holder, the role of holding the magnet switch 600, and the role of holding a pulley 690 which guides the cord-shaped member 680. The brush holder 900 has a hole portion not shown in the drawings through which the cord-shaped member 680 passes.

Figure 12:
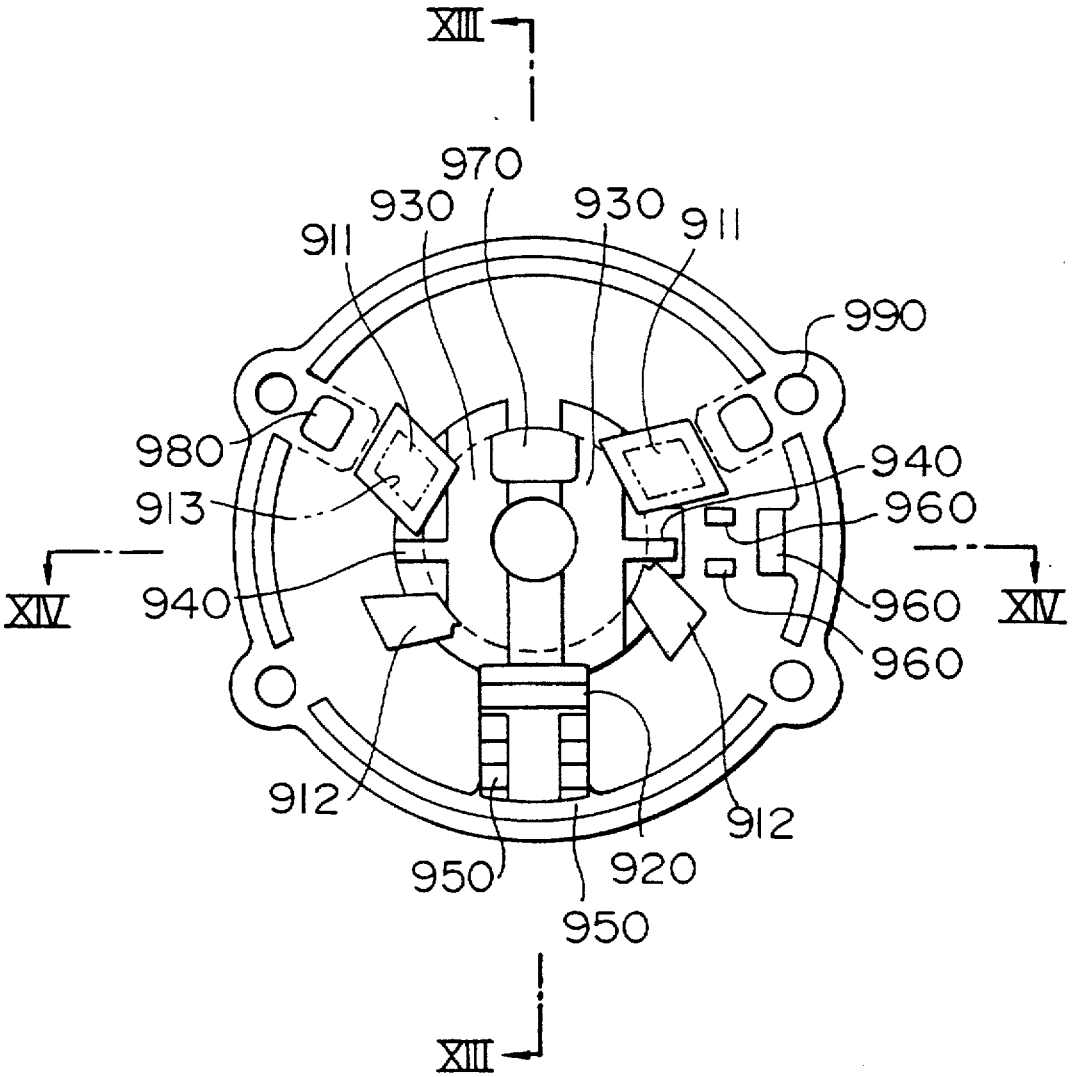
FIG. 12 is a front view of a brush holder.
Figure 13:
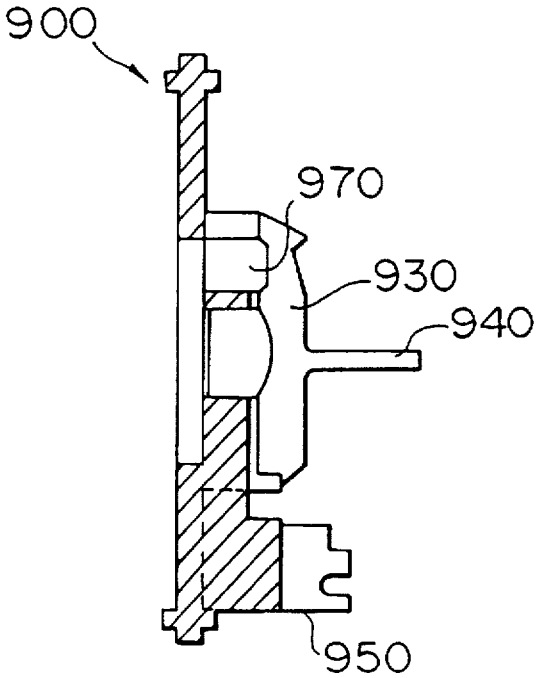
FIG. 13 is a sectional view taken along the line XIII—XIII in FIG. 12.
Figure 14:
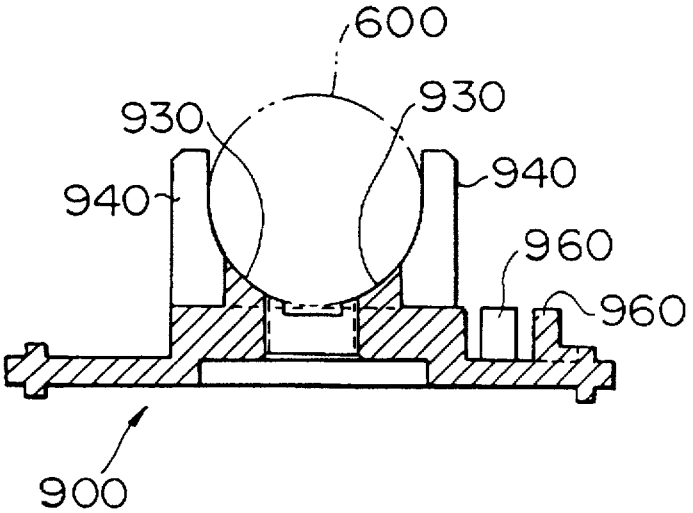
FIG. 14 is a sectional view taken along the line XIV—XIV in FIG. 12.

The brush holder 900 is a spacing wall made of a metal such as aluminum molded by a casting method and, as shown in FIG. 12 through FIG. 14, has a plurality of (in this embodiment, two upper and two lower) brush holding holes 911, 912 which hold the brushes 910 in the axial direction. The upper brush holding holes 911 are holes which hold brushes 910 which receive a plus voltage, and these upper brush holding holes 911 hold the brushes 910 by way of resin (for example nylon, phenol resin) insulating cylinders 913 (FIG. 13 is a cross-section taken along XIII—XIII of FIG. 12, and FIG. 14 is a cross-section taken along XIV—XIV of FIG. 12). The lower brush holding holes 912 are holes which hold brushes 910 connected to ground, and these lower brush holding holes 912 hold the respective brushes 910 directly therein.

In this way, by holding the brushes 910 by means of the brush holder 900, there is no need to provide the starter with independent brush holders. As a result, the number of parts in the starter can be reduced and assembly man-hours can be reduced.

The brushes 910 are urged against the upper layer coil ends 534 at the rear ends of the armature coils 530 by the compression coil springs 914.

The lead wires 910*a* of the upper brushes 910 are electrically and mechanically joined by a joining method such as welding or caulking to the upper movable contact 612 which is moved by the magnet switch 600. The lead wires 910*a* of the lower brushes 910 are caulked and thereby electrically and mechanically joined to a concave portion 920 formed in the rear surface of the brush holder 900. In this embodiment a pair of lower brushes 910 are provided, one lead wire 910*a* is connected to the pair of lower brushes 910, and the middle of the lead wire 910*a* is caulked in the concave portion 920 formed in the rear surface of the brush holder 900.

Two seats 930 with which the front side of the magnet switch 600 abuts and two fixing pillars 940 which hold the periphery of the magnet switch 600 are formed on the rear side of the brush holder 900.

The seats 930 are shaped to match the external shape of the magnet switch 600 in order to abut with the magnet switch 600, which has a cylindrical exterior. The two fixing pillars 940, with the magnet switch 600 in abutment with the seats 930, by having their rear ends caulked to the inner side, hold the magnet switch 600.

A pulley holding portion 950 which holds a pulley 690 which converts the direction of movement of the cord-shaped member 680 from the vertical direction of the magnet switch 600 into the axial direction thereof is formed on the lower side of the rear side of the brush holder 900.

(Operation of the Embodiment)

Next, the operation of the starter described above will be explained with reference to the electrical circuit diagrams FIGS. 15A through 15C.

Figure 15A:
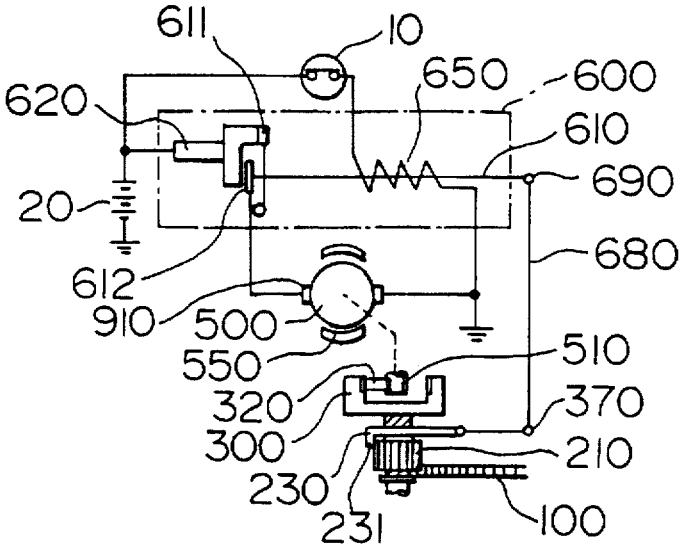
FIGS. 15A through 15C are electrical circuit diagrams in which the operating state of a pinion is shown.

When a key switch 10 is set to the start position by a driver as shown in FIG. 15A, electricity flows from a battery 20 to the attracting coil 650 of the magnet switch 600. When current flows through the attracting coil 650, the plunger 610 is pulled by the magnetic force produced by the attracting coil 650, and the plunger 610 ascends from its lower position to its upper position (from right to left in FIG. 15A).

When the plunger 610 starts to ascend, together with the ascent of the plunger shaft 615 the upper movable contact 612 and the lower movable contact 611 ascend, and the rear end of the cord-shaped member 680 also ascends. When the rear end of the cord-shaped member 680 ascends, the front end of the cord-shaped member 680 is pulled down, and the pinion rotation regulating member 230 descends. When the descent of the pinion rotation regulating member 230 causes the regulating claw 231 to mate with the projections 214 of the periphery of the pinion gear 210, the lower movable contact 611 abuts with the head portion 621 of the terminal bolt 620. The voltage of the battery 20 is impressed on the terminal bolt 620, and the voltage of the terminal bolt 620 is transmitted through the lower movable contact 611→the resistor member 617→the upper movable contact 612→the lead wires 910*a* to the upper brushes 910. That is, the low voltage passing through the resistor member 617 is transmitted through the upper brushes 910 to the armature coils 530. Because the lower brushes 910 are constantly grounded through the brush holder 900, a current flows at low voltage through the armature coils 530 constituted in coil form by the paired upper layer coil bars 531 and lower layer coil bars 532. When this happens, the armature coils 530 generate a relatively weak magnetic force, this magnetic force acts on (attracts or repels) the magnetic force of the fixed poles 550, and the armature 540 rotates at low speed.

When the armature shaft 510 rotates, the planetary gears 320 of the planetary gear speed reduction mechanism 300 are rotationally driven by the sun gear 310 on the front end of the armature shaft 510. When the planetary gears 320 exert a rotational torque through the planet carrier 330 on the internal gear 340 in the direction which rotationally drives the ring gear 100, the rotation of the internal gear 340 is limited by the operation of the overrunning clutch 350. That is, because the internal gear 340 does not rotate, the rotation of the planetary gears 320 causes the planet carrier 330 to rotate at low speed. When the planet carrier 330 rotates, the pinion gear 210 also rotates, but because the pinion gear 210 has its rotation limited by the pinion rotation regulating member 230 the pinion gear 210 advances along the helical spline 221 on the output shaft 220.

Together with the advance of the pinion gear 210, the shutter 420 also advances, and opens the opening portion 410 of the housing 400. The advance of the pinion gear 210 causes the pinion gear 210 to mesh completely with the ring gear 100 and then abut with the pinion stopping ring 250. Also, when the pinion gear 210 advances, the regulating claw 231 disengages from the projections 214 of the pinion gear 210 and after that the front end of the regulating claw 231 drops to the rear side of the washer 215 disposed on the rear side of the pinion gear 210.

Figure 15B:
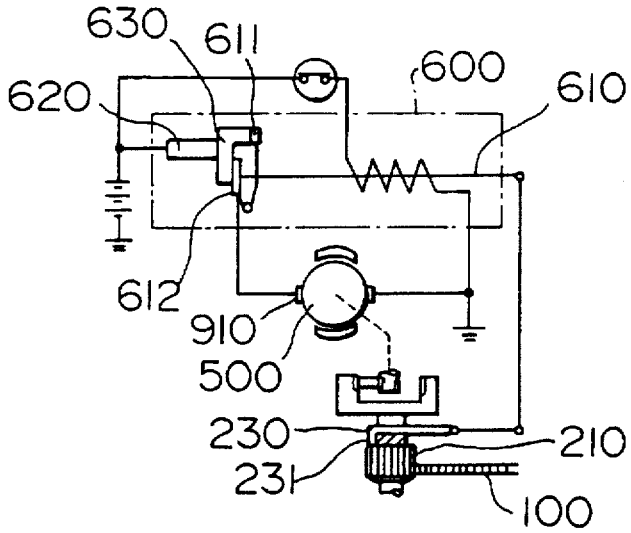

With the pinion gear 210 advanced, the upper movable contact 612 abuts with the abutting portion 631 of the fixed contact 630 as shown in FIG. 15B. When this happens, the battery voltage of the terminal bolt 620 is directly transmitted through the upper movable contact 612→the lead wires 910*a* to the upper brushes 910. That is, a high current flows through the armature coils 530 consisting of the upper coil bars 531 and the lower coil bars 532, the armature coils 530 generate a strong magnetic force and the armature 540 rotates at high speed.

The rotation of the armature shaft 510 is slowed and has its rotational torque increased by the planetary gear speed reduction mechanism 300 and rotationally drives the planet carrier 330. At this time, the front end of the pinion gear 210 abuts with the pinion stopping ring 250 and the pinion gear 210 rotates integrally with the planet carrier 330. Because the pinion gear 210 is meshing with the ring gear 100 of the engine, the pinion gear 210 rotationally drives the ring gear 100 and rotationally drives the output shaft of the engine.

Next, when the engine starts and the ring gear 100 of the engine rotates faster than the rotation of the pinion gear 210, the action of the helical spline creates a force tending to retract the pinion gear 210. However, the regulating claw 231 which has dropped to behind the pinion gear 210 prevents the pinion gear 210 from retracting, prevents early disengagement of the pinion gear 210, and enables the engine to be started surely.

When the engine starting causes the ring gear 100 to rotate faster than the rotation of the pinion gear 210, the rotation of the ring gear 100 rotationally drives the pinion gear 210. When this happens, the rotational torque transmitted from the ring gear 100 to the pinion gear 210 is transmitted through the planet carrier 330 to the pins 332 which support the planetary gears 320. That is, the planetary gears 320 are driven by the planet carrier 330. When this happens, because a torque rotationally opposite to that during engine starting is exerted on the internal gear 340, the overrunning clutch 350 allows the rotation of the ring gear 100. That is, when a torque rotationally opposite to that during engine starting is exerted on the internal gear 340, the roller 353 of the overrunning clutch 350 detaches to outside the concave portion 355 of the clutch inner 352 and rotation of the internal gear 340 becomes possible.

In other words, the relative rotation with which the ring gear 100 rotationally drives the pinion gear 210 when the engine starts is absorbed by the overrunning clutch 350, and the armature 540 is never rotationally driven by the engine.

Figure 15C:
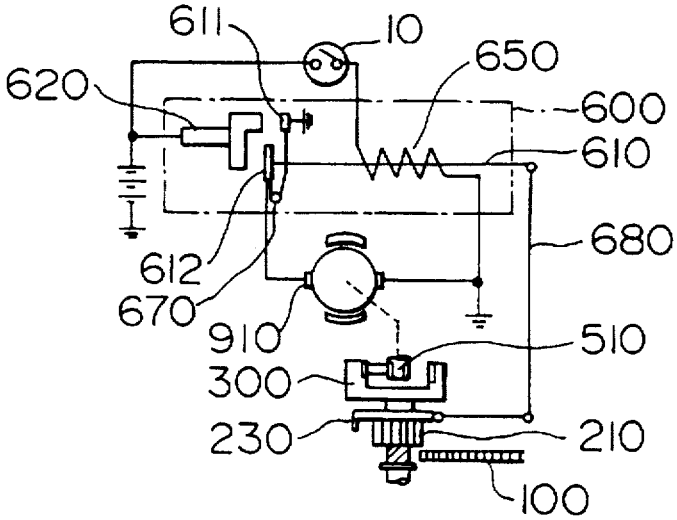

When the engine starts, the driver releases the key switch 10 from the start position as shown in FIG. 15C and the flow of current to the attracting coil 650 of the magnet switch 600 is stopped. When the flow of current to the attracting coil 650 stops, the plunger 610 is returned downward by the action of the compression coil spring 660.

When this happens, the upper movable contact 612 moves away from the abutting portion 631 of the fixed contact 630, and after that the lower movable contact 611 also moves away from the head portion 621 of the terminal bolt 620, and the flow of current to the upper brushes 910 is stopped.

When the plunger 610 is returned downward, the action of the return spring portion 236 of the pinion rotation regulating member 230 causes the pinion rotation regulating member 230 to return upward, and the regulating claw 231 moves away from the rear of the pinion gear 210. When this happens, the pinion gear 210 is returned rearward by the action of the return spring 240, the meshing of the pinion gear 210 with the ring gear 100 of the engine is disengaged, and the rear end of the pinion gear 210 abuts with the flange-like projecting portion 222 of the output shaft 220. That is, the pinion gear 210 is returned to the position it was in before the starter was started.

Also, the plunger 610 being returned downward causes the lower movable contact 611 to abut with the upper surface of the stationary core 642 of the magnet switch 600, and the lead wires of the upper brushes 910 conduct electrical current in the order the upper movable contact 612→the resistor member 617→the lower movable contact 611→the stationary core 642→the magnet switch cover 640→the brush holder 900. In other words, the upper brushes 910 and the lower brushes 910 short-circuit through the brush holder 900. Meanwhile, inertial rotation of the armature 540 generates an electromotive force in the armature coils 530. Because this electromotive force is short-circuited through the upper brushes 910, the brush holder 900 and the lower brushes 910, a braking force is exerted on the inertial rotation of the armature 540. As a result, the armature 540 rapidly stops.

(Advantages of the Embodiment)

According to the starter described above, the magnet switch 600 is set apart from the pinion 210 so the distance between the plunger 510 of the magnet switch 600 and the pinion rotation regulating member 230 can be lengthened, and the cord-shaped member 680 that acts as the coupling means can be lengthened. Therefore, the impact force generated when the pinion 210 and ring gear 100 engage can be absorbed by this long cord-shaped member, and prevented from being conveyed directly to the plunger 621. Thus vibration of the plunger 610 is eliminated, and separation between the lower movable contact 611 and terminal bolt 620 can be accurately prevented.

As the pinion gear 210 is moved to the ring gear 100 side via the cord-shaped member and via the pinion rotation regulating member 230, the conventional link mechanism and levers, etc., are not required, by that reducing the number of parts. Even if the pinion gear 210 does not separate from the ring gear 100 when the pinion gear 210 is engaged with the ring gear 100, the plunger 610 returns to the original position due to the slackening of the cord-shaped member, and the movable contacts 611 and 612 separate from the fixed contact 630.

As the rotation of pinion gear 210 is restricted by moving the pinion rotation regulating member 230 to the pinion gear 610 side, the strong force conventionally required to rub the regulating portion against the pinion is not required, so the pinion rotation regulating member 230 can be accurately moved with the cord-shaped member 680.

As the regulating claw 231 of the pinion rotation regulating member 230 only need to be fit with the groove 213 formed on the pinion gear 210, the regulating claw can be accurately moved by the cord-shaped member 680.

By using a wire for the cord-shaped member, the durability can be improved.

By laying the adjustment mechanism configured of the male screw 683 and fixing screw 684 between the plunger 610 and cord-shaped member 680, the length of the cord-shaped member can be easily determined.

Furthermore, the length of the cord-shaped member can be easily adjusted by screwing the fixing screw 684 that acts as the adjustment member into the concave portion 682.

Furthermore, by laying the cord- shaped member between the plunger 610 of the magnet switch 600 and the pinion rotation regulating member 230 that acts as the pinion regulating means, and passing the member through the field magnetic pole 550 of the starter motor 500, the conventional link mechanism and levers, etc., are not required, by that reducing the number of parts. Even if the pinion gears 210 do not separate from the ring gear 100 when the pinion gear 210 is engaged with the ring gear 100, the plunger 610 returns to the original position due to the slackening of the cord-shaped member, and the movable contacts 611 and 612 separate from the fixed contact 630.

At the same time, the cord-shaped member 680 is passed through the small clearance between the field magnetic poles 550 so a space does not need to be created for the cord-shaped member 680.

[SECOND EMBODIMENT]

Figure 16:
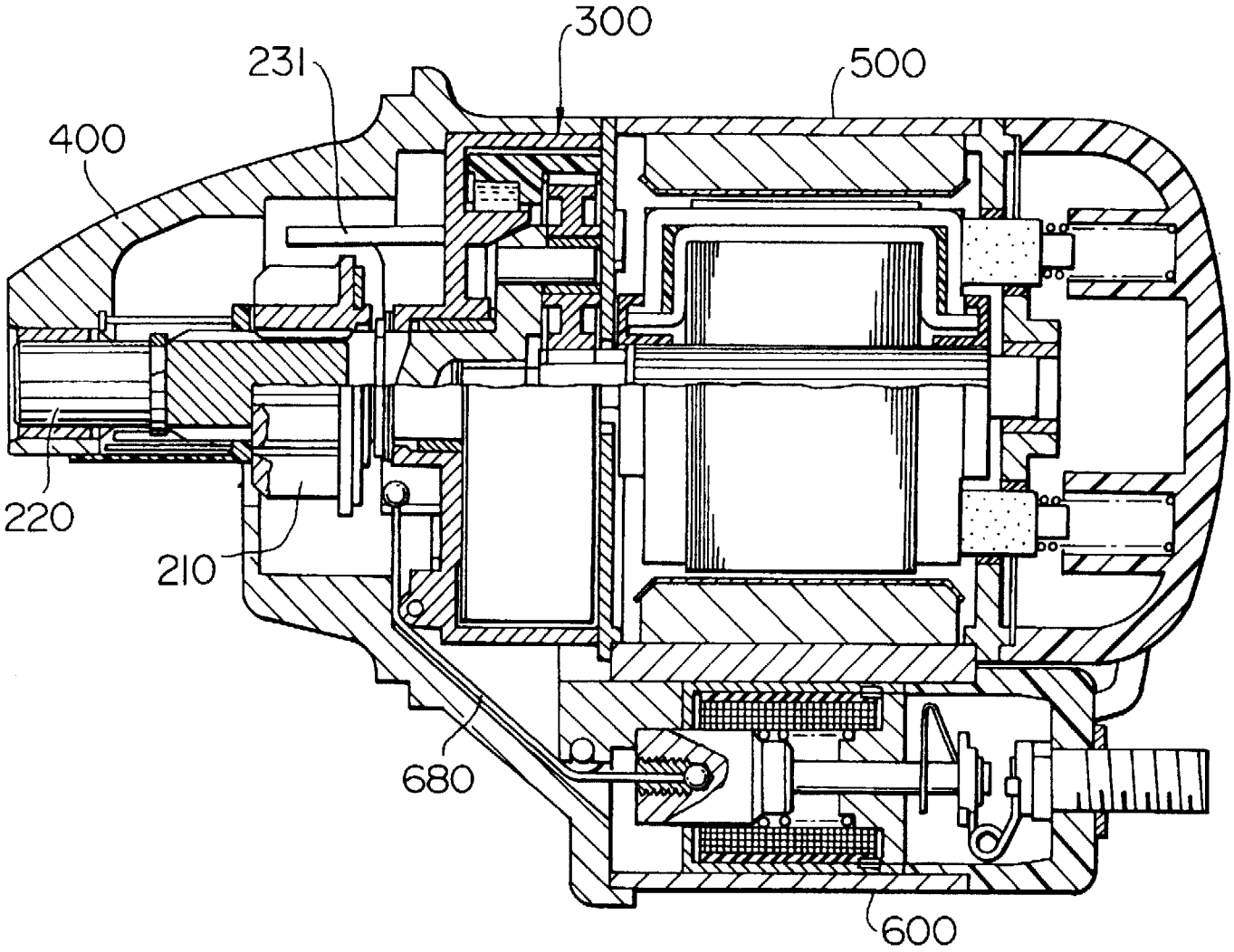
FIG. 16 is a sectional view of the second embodiment of the present invention.

In the second embodiment illustrated in FIG. 16, a magnet switch 600 is laid in parallel with a starter motor 500, while using a cord-shaped member 680 in the similar manner as in the first embodiment.

[THIRD EMBODIMENT]

Figure 17:
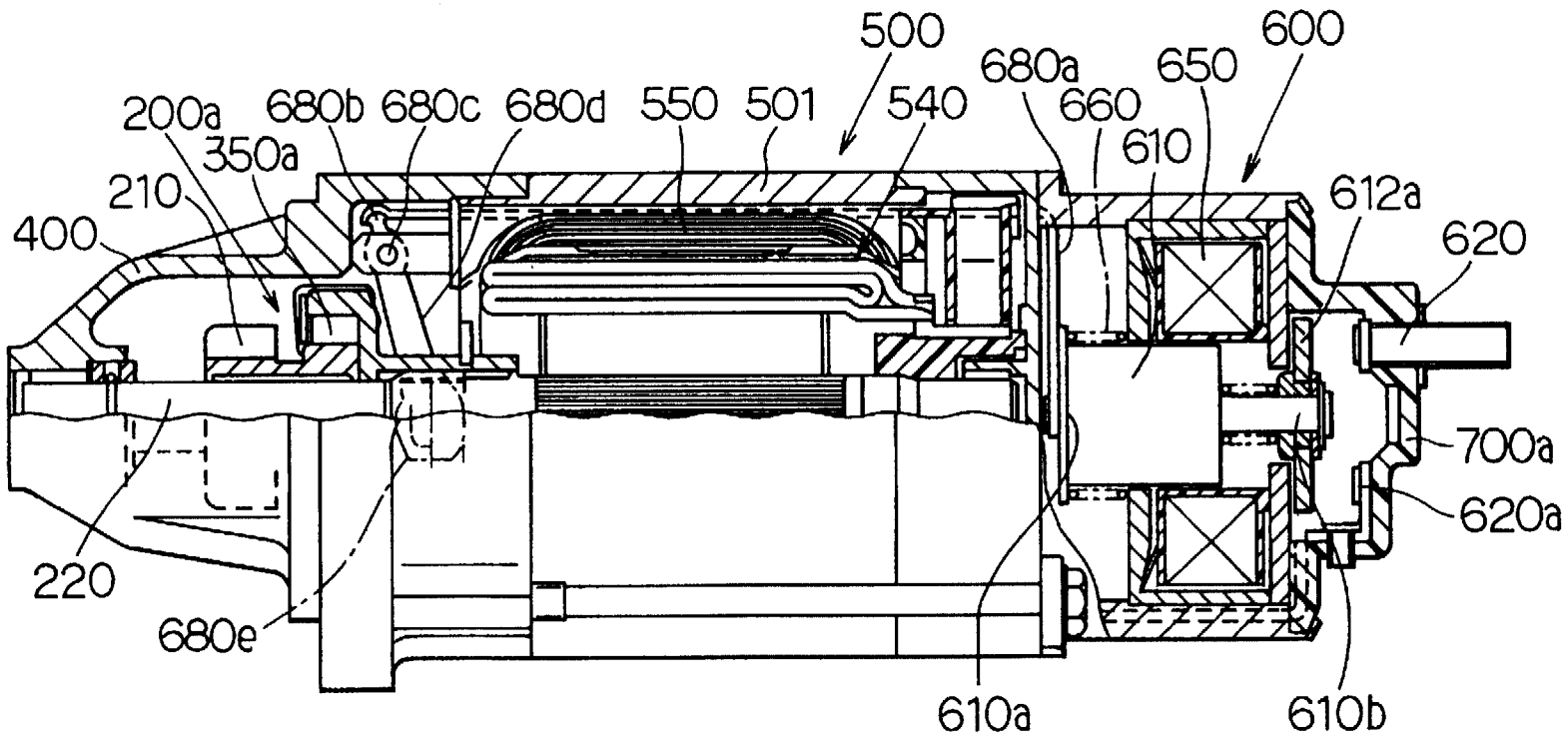
FIG. 17 is a sectional view of the third embodiment of the present invention.

According to the third embodiment shown in FIG. 17, a pinion moving member 200*a* includes a pinion gear (pinion) 210 for engagement with a ring gear and a one-way clutch 350*a*. The pinion gear 210 is disposed at one axial side of a motor 500 and mounted on an output shaft 220 integral with the motor shaft so that it slides axially when driven by the motor 500 through the clutch 350*a*. The clutch 350*a* is spline-engaged with the output shaft 220 and axially slidable. Thus, the clutch 350*a*, when driven by the motor 500, transmits the rotation of the motor 500 to the pinion gear 210, while it prevents the motor 500 from being reversely driven by the ring gear when the ring gear rotates faster than the pinion gear 210 and the reverse torque exerts on the pinion gear 210.

A magnet switch 600 is disposed concentrically with the motor 500 at the other axial side of the motor 500. The magnet switch 600 includes a coil 650 and a plunger 610 disposed movably within the coil 650. A return spring 660 normally biases the plunger 610 toward the motor 500 and the pinion gear 210. The plunger 610 has a movable contact 612*a* at one axial end 610*b* thereof so that, when the plunger 610 is attracted axially by the coil 650, the movable contact 612*a* contacts two fixed contacts (battery terminal contact and motor terminal contact) 620 and 620*a* which are fixed to an electrically insulating rear cover 700*a*. The battery terminal contact 620 is connected to a storage battery through a battery cable, while the motor terminal contact 620*a* is connected to the motor 500.

A link mechanism is provided between the pinion moving member 200*a* and the magnet switch 600. The link mechanism includes a connecting member 680*a* which is fixed to one axial end 610*a* of the plunger 610 and extends radially and axially through a space between adjacent two of circumferentially arranged fixed magnetic poles 550 constructed by field coils. The link mechanism further includes a lever 680*d* having one end 680*b* engaged with one axial end of the connecting member 680*a* and the other end 680*e* engaged with the clutch 350*a*.

The connecting member 680*a* is made of an L-shaped rigid plate and moves axially, when the plunger 610 moves axially by energization of the coil 650 for driving the motor 500, keeping its L-shape. Thus, the connecting member 680*a* moves the end 680*b* of the lever 680*d* toward the motor 500 and the magnet switch 600 so that the lever 680*d* turns around the fixed axis 680*c*. As a result, the end 680*e* of the lever 680*d* is moved toward the ring gear thereby to move the pinion moving member 200*a* to cause engagement of the pinion gear 210 with the ring gear for engine starting by the motor 500. When the plunger 610 returns axially by deenergization of the coil 650 for stopping the rotation of the motor 500, on the other hand, the connecting member 680*a* also returns toward the ring gear side thereby to turn the lever 680*d* in the opposite direction. As a result the pinion moving member 200*a* is moved toward the motor 500 disengaging the pinion gear 210 from the ring gear.

In the third embodiment, the connecting member 680*a* need not be made of the rigid metal but may be replaced by a flexible cord member as long as the lever 680*d* is turned by the plunger 610 to engage and disengage the pinion gear 210 with and from the ring gear.

According to the third embodiment, since the connecting member 680*a* is arranged to extend axially inside a yoke, i.e., between the two circumferentially adjacent fixed poles 550, the outer diameter of the motor 500 need not be enlarged.

Further, since the magnet switch 600 is disposed axially opposite to the pinion moving member 200*a* with respect to the motor 500, the starter has no protruding portion which protrudes radially outwardly from the motor 500. Thus, the starter may be mounted on an engine without being restricted in mounting location in an engine compartment of a vehicle in which various engine accessory equipment are likely to restrict mounting of a starter.

[FOURTH EMBODIMENT]

Figure 18:
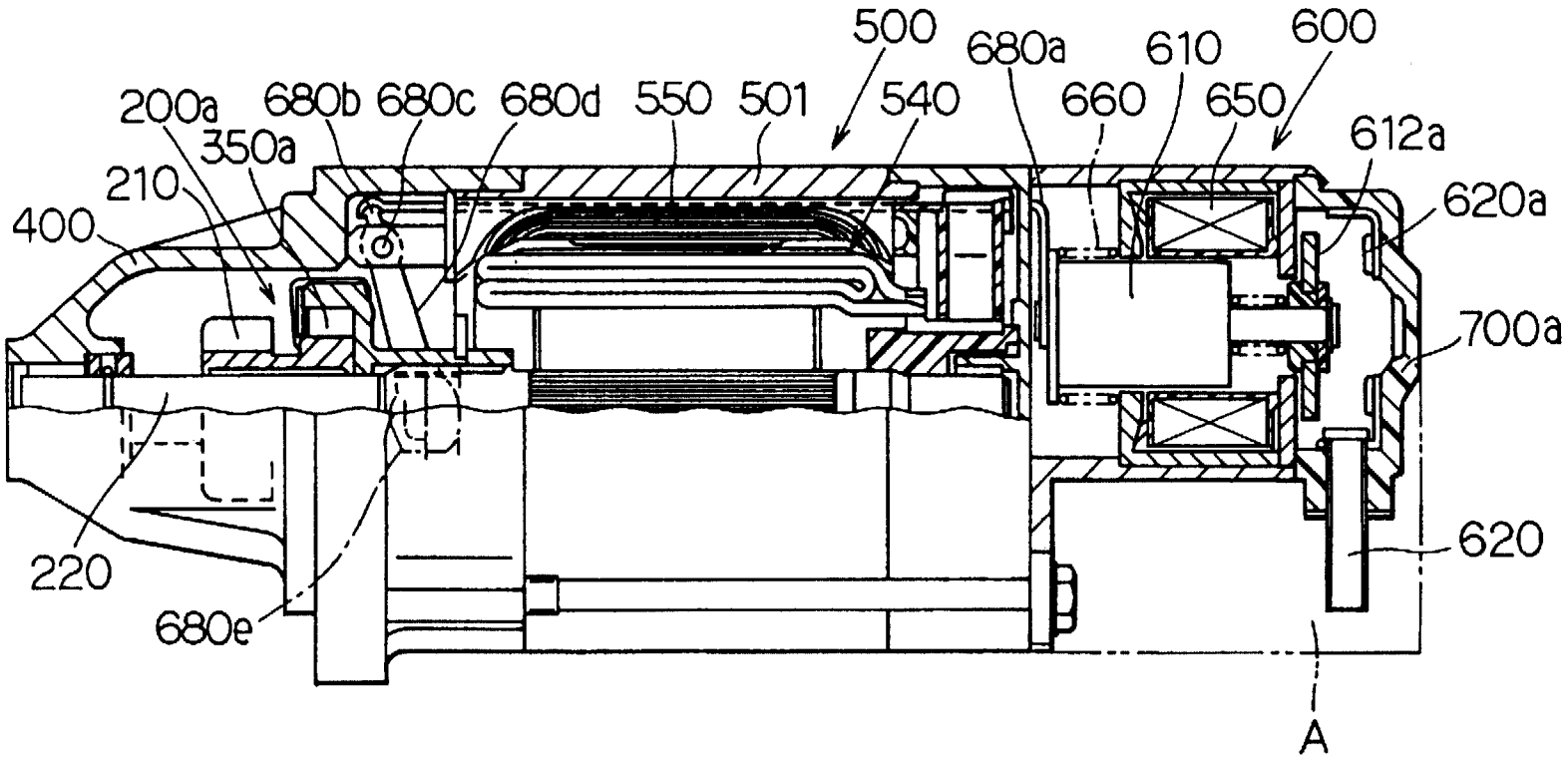
FIG. 18 is a sectional view of the fourthe embodiment of the present invention.

In the fourth embodiment shown in FIG. 18, although a magnet switch 600 is disposed axially opposite to a pinion moving member 200*a* with respect to a motor 500 in the same manner as in the third embodiment, the magnet switch 600 is not concentric with the motor 500 but deviated in the radial direction within the radial outermost confine of the motor 500. That is, the magnet switch 600 is positioned at an upper side in FIG. 18. Within a space A provided by the deviation of the magnet switch 600, i.e., at a lower side in FIG. 18, a battery terminal 620 is provided to extend orthogonally to an output shaft 220.

According to this construction, since the battery terminal 620 does not extend axially from a rear cover 700*a* but extends radially, the entire axial length of the starter may be shortened.

In the third and the fourth embodiments, although the plunger 610 and the lever 680*d* are connected via the connecting member 680*a* to transmit directly the movement of the plunger 610 to the lever 680*d*, a moving force absorbing member such as a spring may be disposed between the armature 540 and the lever 680*d* to absorb a moving force of one of the two so that even when the end surface of the pinion gear 210 is in abutment with the end surface of the ring gear the coil 650 of the magnet switch 600 may be energized.

Further, a planetary gear speed reduction mechanism may be provided between the motor 500 and the pinion gear 210 thereby to increase a rotational torque of the pinion gear 210. The field poles 550 may be constructed by permanent magnets.

[FIFTH EMBODIMENT]

Figure 19:
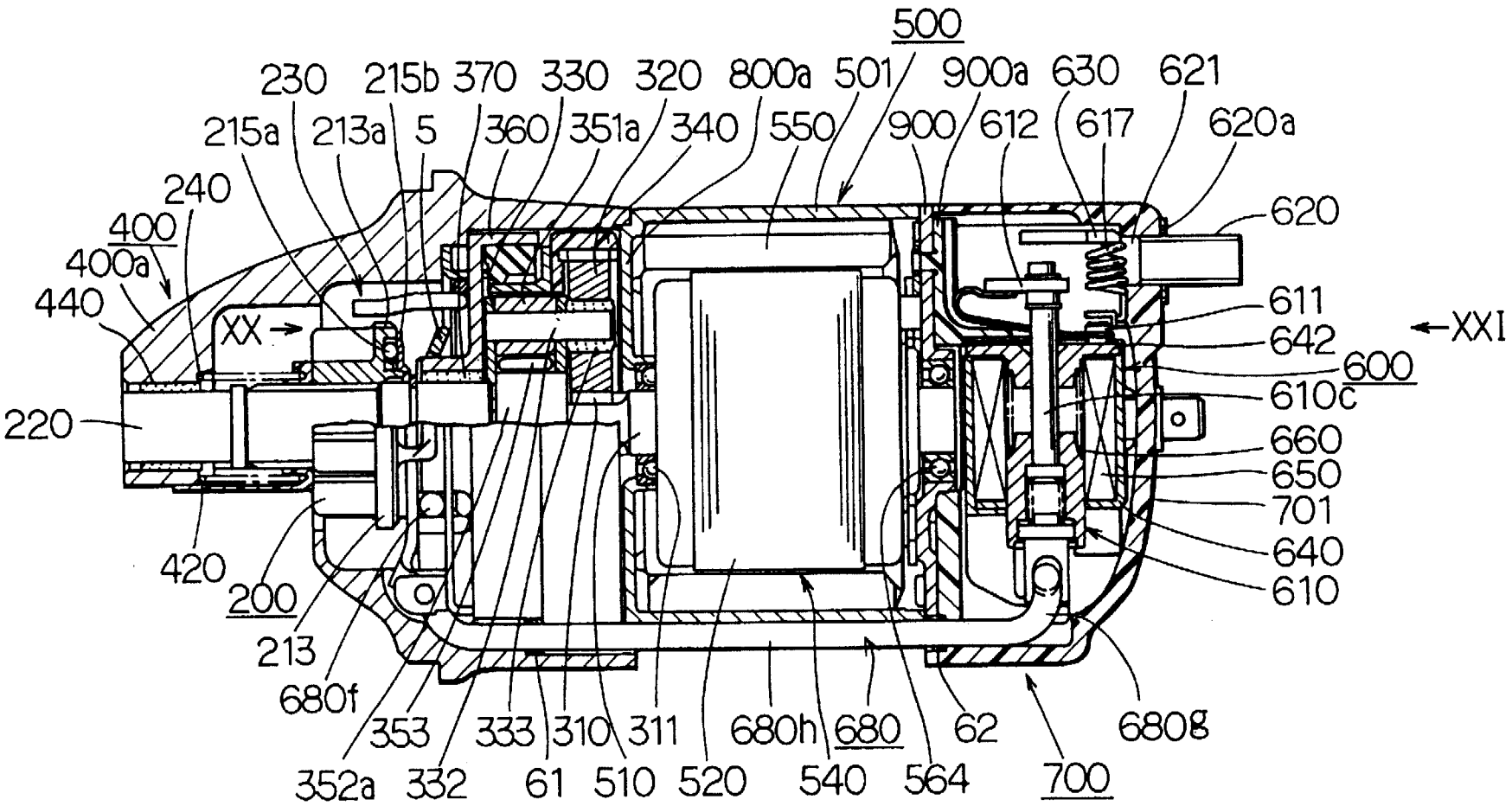
FIG. 19 is a sectionnal viw showing the entirety of a starter according to a fifth embodiment.

A starter of the present embodiment shown in FIG. 19 is constructed to include: a starter motor 500 for generating a rotating force when energized; an output shaft 220 arranged coaxially with the axis of rotation of the starter motor 500; a rotating force transmitting mechanism for transmitting the rotating force of the starter motor 500 to the output shaft 220; a pinion 200 fitted on the outer circumference of the output shaft 220; a rotation regulating member 230 for regulating the rotation of the pinion 200 while the pinion 200 is meshing with the ring gear (not shown) of an engine after the same meshed; a retraction regulating member 5 for regulating the retraction of the pinion 200; and a magnet switch 600 arranged at the back of the starter motor 500.

The starter motor 500 is constructed to include a yoke 501, a stationary magnetic pole 550, an armature 540 and a (not-shown) brush. The yoke 501 is formed into a cylindrical shape and is sandwiched, together with a bearing holding plate 900 to be arranged at its rear end side (as located at the right end side in FIG. 19), between a housing 400 and an end cover 700.

The stationary magnetic pole 550 to be used is exemplified by a permanent magnet and is fixed on the inner circumference of the yoke 501 to establish a magnetic field. Incidentally, the stationary magnetic pole 550 may also be exemplified by such a field coil in place of the permanent magnet as will generate a magnetic force when energized.

The armature 540 is constructed to include an armature shaft 510 forming a rotational shaft, a core 520 disposed around the armature shaft 510, a coil (not-shown) mounted on the core 520, and a commutator (not-shown) mounted on the rear end face of the core 520. In this armature 540, the shaft 510 is so arranged coaxially with the output shaft 220 at the back of the output shaft 220 that its one side is rotatably supported by a bearing 564, which is arranged in a→partition 800*a* formed in the yoke 501 to partition the armature 540 and a (later-described) planetary gear speed reduction mechanism, and that its other end side is rotatably supported by the bearing holding plate 900 through the bearing 564.

The brush is held by a holder 900*a* engaging with the bearing holding plate 900 and is urged against the commutator by the spring (not-shown) assembled in the end cover 700.

The output shaft 220 has its leading end rotatably supported through a bearing 440 by a bearing portion 400*a* of the housing 400 and its rear end portion rotatably supported through a bearing 370 by a center case 360.

There is mounted on the rear end of the output shaft 220 a planet carrier 330 of the planetary gear speed reduction mechanism. The center case 360 is so fixed in the inner circumference of the rear end side of the housing 400 as covers the outer circumference of the rotating force transmitting mechanism. This transmitting mechanism is constructed to include the planetary gear speed reduction mechanism and a one-way clutch.

The planetary gear speed reduction mechanism is a speed reduction mechanism for increasing the output torque of the starter motor 500 by reducing the rotational speed of the starter motor 500 and is constructed to include a sun gear 310 formed on the outer circumference of the leading end of the shaft 510, three planetary gears 320 meshing with the sun gear 310, an internal gear 340 meshing with the individual planetary gears 320, and the aforementioned planet carrier 330. In this planetary gear speed reduction mechanism, when the sun gear 310 rotates together with the shaft 510, the individual planetary gears 320 in meshing engagement with the sun gear 310 and the internal gear 340 revolve in the same direction as that of the sun gear 310 while rotating (in the opposite direction to the sun gear 310) so that their revolving force is transmitted through the pin 332 to the planet carrier 330 to rotate the output shaft 220.

The one-way clutch is constructed to include an outer member 351*a*, which is fixed on the pin 332 fixed on the planet carrier 330, an inner member provided on the output shaft 220, and a roller 353.

The pinion 200 is helically splined on the outer circumference of the leading end side of the output shaft 220 in the housing 400 and is always urged backward (i.e., rightward of FIG. 19) of the output shaft 220 by a spring 240 which is arranged at the leading end side of the pinion 200. Incidentally, this spring 240 urges the pinion 200 through a shutter 420 which is fitted on the outer circumference of the output shaft 220 in front of the pinion 200. On the other hand, the shutter 420 is associated with the movement of the pinion 200 to open/close the (not-shown) opening portion which is opened in the housing 400 at the side of the ring gear.

At the rear end side of the pinion 200, there is integrally formed a flange 213 which has a larger external diameter than that of the pinion 200 and has a number of recesses 213*a* in its outer circumference. Incidentally, the recesses 213*a* are formed in a larger number than that of the external teeth of the pinion 200.

At the rear end side of the flange 213, on the other hand, there is assembled a thrust bearing 215*b* which is made rotatable through a thrust bearing 215*b* in the rotational direction of the pinion 200.

Figure 20:
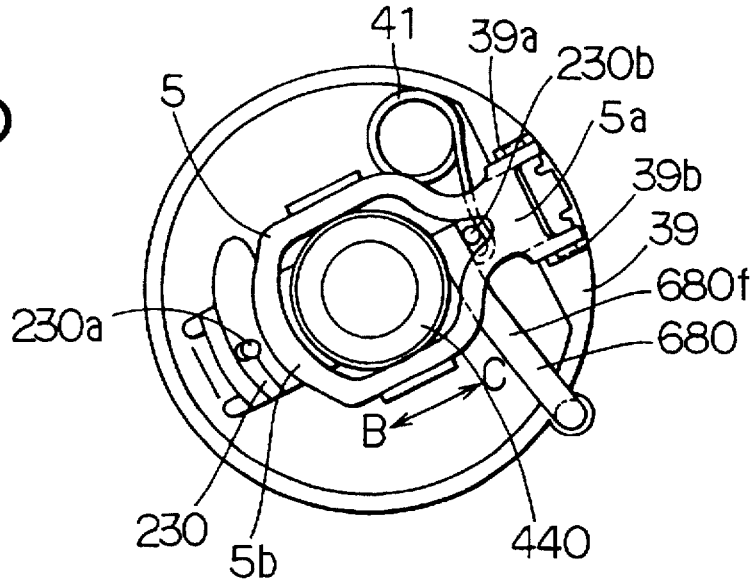
FIG. 20 is a side view taken in the direction XX of FIG. 19 and shows a retraction regulating member and a rotation regulating member.

The retraction regulating member 5 is constructed, as shown in FIGS. 19 and 20, to include a connection portion 5*a* engaging with the (not-shown) holes individually arranged in two plate projecting portions 39*a* and 39*b* provided on a plate 39, and an abutment portion 5*b* abutting against a first projecting portion 6*a* of the rotation regulating member 230. A portion of the outer circumference of the retraction regulating member 5 is engaged by the two (not-shown) claw portions formed at the thrust ring 36 so that the retraction regulating member 5 rocks on the aforementioned holes together with the pinion 200. The plate 39 is clamped between the housing 400 and the center case 360.

The rotation regulating member 230 is formed by winding a rod-shaped metal material and is provided at its individual leading end with a first projecting portion 6*a* to abut against the abutment portion 5*b* of the retraction regulating member 5 and a second projecting portion 6*b* to abut against an actuating portion 680*f* which is provided at a rod-type connecting member 680. These first and second projecting portions 6*a* and 6*b* are raised at a right angle in the same direction but in radially opposite positions.

This rotation regulating member 230 is accommodated, as shown in FIG. 19, in a space between the center case 360 and the plate 39 such that the first and second projecting portions 6*a* and 6*b* are extracted forward from the plate 39 and that the space can move in the directions B and C of FIG. 20. Moreover, the rotation regulating member 230 is always urged in the direction B of FIG. 20 by a spring 41 which is attached to the plate 39. As a result, the rotation regulating member 230 is moved in its entirety in the direction C of FIG. 20 against the urging force of the spring 41, when the attraction of the magnet switch 600 is transmitted through the connecting member 680 to the second projecting portion 6*b*, and is moved in the direction B of FIG. 20 to restore its initial position when the magnet switch 600 is turned OFF so that the attraction disappears.

The magnet switch 600 is arranged, as shown in FIG. 19, in the end cover 700 while being held at the rear end side of the bearing holding plate 900, and is so fixed that its actuating direction intersects the shaft 510 of the starter motor 500.

This magnet switch 600 is constructed to include a switch cover 640, a coil 650, a stationary iron core 642, a plunger 610, a spring 46 and a rod 610*c*. The switch cover 640 is made of a magnetic material (e.g., iron) and press-molded into a cup shape having a through hole at the central portion of its bottom face (i.e., a lower face of FIG. 19) for allowing the plunger 610 to slide freely therethrough.

The coil 650 is connected through the starter switch (or the not-shown ignition switch) of a vehicle with the car-mounted battery so that it establishes the magnetic force when energized by turning ON the starter switch. The stationary iron core 642 is arranged at the upper end side of the coil 650 and is fixedly caulked in the opening portion of the switch cover 640.

The plunger 610 is made of a magnetic material (e.g., iron) into a generally cylindrical shape and is so arranged in the hollow inside of the coil 650 as to face the stationary iron core 642 so that it is attracted toward the stationary iron core 642 (i.e., upward of FIG. 19), as magnetized when the coil 650 is energized. Incidentally, the bottom portion of the plunger 610 is engaged by a moving portion 680*g* of the connecting member 680.

The spring 46 is interposed in the inner circumference of the coil 650 between the plunger 610 and the stationary iron core 642 thereby to urge the plunger 610 downward (as seen in FIG. 19) relative to the stationary iron core 642. Specifically, when the energization of the coil 650 is interrupted, the plunger 610, which has been attracted till then toward the stationary iron core 642 against the urging force of the spring 46, is returned to its initial position.

The rod 610*c* is extended, while being fixed at the upper portion side of the plunger 610, through the hollow inside of the coil 650 until it is protruded upward and slidably through a through hole which is opened in the central portion of the stationary iron core 642.

The magnet switch 600 is arranged in the vicinity of the starter motor 500 at the opposite side to the pinion 200 and generally upright with respect to the shaft 510 of the armature 540.

The contact structure is constructed to include a terminal bolt 620 fixed in the end cover 700, a fixed contact 49 fitted at the head portion 620 of the terminal bolt 620 and connected with a starting resistor 617, a main movable contact 612 to be connected with the lead line of a positive electrode brush, and an auxiliary movable contact 611 to be connected with the main movable contact 612 through a copper plate.

The terminal bolt 620 is inserted through the bottom wall 701 of the end cover 700 until its leading end side is exposed to the outside of the end cover 700, and is fixed in the end cover 700 by fastening a washer 620*a*. This terminal bolt 620 is connected with the positive electrode of the battery by a power supply line.

The fixed contact 49 is fixed in the end cover 700 by welding it to the head portion 620 of the terminal bolt 620.

The main movable contact 612 is arranged to face the fixed contact 49 and is slidably fitted on the rod 610*c* of the magnet switch 600.

The starting resistor 617 is wound with a nickel wire, for example, and is arranged such that its one end is connected with the fixed contact 49 and its other end is opposed to the auxiliary movable contact 611.

The auxiliary movable contact 611 is so arranged to face the starting resistor 617 that it comes into abutment against the starting resistor 617, which is electrically connected with the terminal bolt 620 as the rod 610*c* moves, when the magnet switch 600 is turned ON so that the plunger 610 is attracted, and comes into abutment against the outer end face of the stationary iron core 642 to acquire its electric conduction when the magnet switch 600 is turned OFF.

The distance between the main movable contact 612 and the fixed contact 49 is set shorter than that between the auxiliary movable contact 611 and the starting resistor 617. When the magnet switch 600 is turned ON so that the plunger 610 is attracted toward the stationary iron core 642, the auxiliary movable contact 611 comes into abutment against the starting resistor 617 to be electrically connected with the terminal bolt 620, before the main movable contact 612 abuts against the fixed contact 49, so that the battery voltage is applied through the starting resistor 617 to the armature 540 of the starter motor 500.

Figure 21:
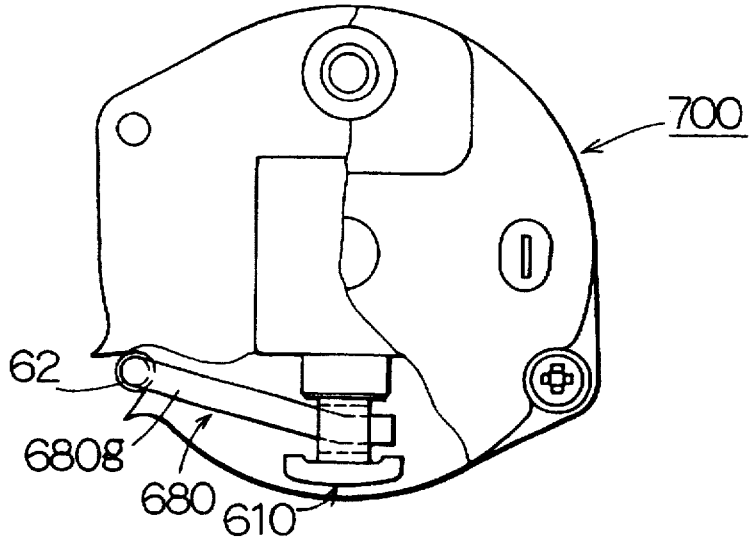
FIG. 21 is a partial sectional view taken in the direction XXI in FIG. 19, of an end cover.
Figure 22:
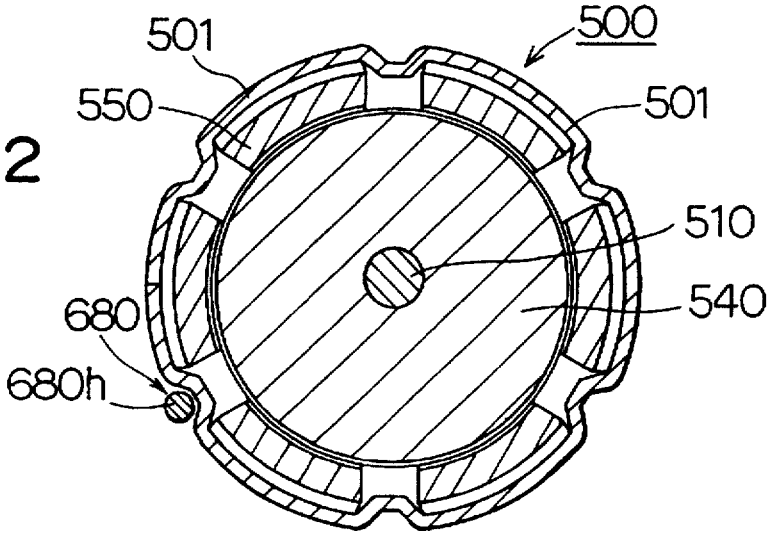
FIG. 22 is a sectional side view of a lever arranged around a yoke.
Figure 24:
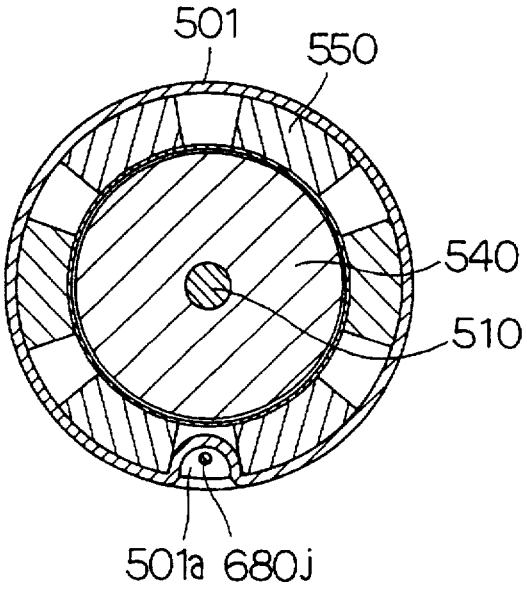
FIG. 24 is a sectional view taken along XXIV—XXIV in FIG. 23.

As shown in FIGS. 21 and 24, the connecting member 680 is made of a material having a proper resiliency such as iron and is constructed to include a moving portion 680*g* engaging with the plunger 610 so that it moves as the plunger 610 moves, an actuating portion 680*f* for abutting to actuate the second projecting portion 6*b* of the rotation regulating member 230, and a rod-shaped portion having such a straight rod shape as to connect the moving portion 680*g* and the actuating portion 680*f*. This rod-shaped portion 680*h* is arranged radially outside of the armature 540 and is extended generally in parallel with the shaft 510. That is, definition of "generally in parallel" implies that the rod-shaped portion 680*h* makes an angle ranging from 0 to 20 degrees with respect to the axis of the shaft 510.

Moreover, the moving portion 680*g* and the actuating portion 680*f* are individually extended from the two ends of the rod-shaped portion 680*h* radially outward of the axis of the rod-shaped portion 680*h*. The angle, as made on the axis of the rod-shaped portion 680*h* by the moving portion 680*g* and the actuating portion 680*f*, has a predetermined value (e.g., about 60 degrees). The rod-shaped portion 680*h* is supported by two bearings 61 and 62 made of a resin. Of these, the bearing 61 is sandwiched between the housing 400 and the center case 20, and the bearing 62 is sandwiched between the end cover 700 and the bearing holding plate 900.

(Operation)

When the starter switch is turned ON by the driver, the coil 650 of the magnet switch 600 is energized so that the plunger 610 is attracted against the urging force of the spring 46 to the magnetized stationary iron cover 44.

In accordance with this movement of the plunger 610, the moving portion 680*g* of the connecting member 680 is turned on the axis of the rod-shaped portion 680*h* to turn not only the rod-shaped portion 680*h* of the connecting member 680, as supported by the bearings 61 and 62, but also the actuating portion 680*f* on the axis of the rod-shaped portion 680*h*. As a result, the rotation regulating member 230 is moved by a predetermined distance in the direction C of FIG. 20, while allowing the actuating portion 680*f* to abut against its second projecting portion 6*b*, so that its first projecting portion 6*a* comes into engagement with the recess 213*a*, as formed in the outer circumference of the flange 213, to regulate the rotation of the pinion 200.

As the plunger 610 ascends, on the other hand, the auxiliary movable contact 611 comes into abutment against the starting resistor 617, as electrically connected with the terminal bolt 620, to energize the positive electrode brush through the starting resistor 617 so that the starter motor 500 is started to rotate the armature 540 with a low voltage being applied. This rotation of the armature 540 is decelerated by the planetary gear speed reduction mechanism and is transmitted to rotate the output shaft 220. This rotation of the output shaft 220 would cause the rotation of the pinion 200 which is rotationally regulated by the first projecting portion 6*a*, but acts as a thrust to push out the pinion 200 in the axial direction. As a result, the pinion 200 can advance along the helical spline with respect to the output shaft 220 to mesh with the ring gear.

On the other hand, the retraction regulating member 5 is pulled to rock, on the holes of the two projecting portions 39*a* and 39*b* formed on the plate 39, together with the pinion 200 by the thrust ring 36 as the pinion 200 advances.

When the pinion 200 completely comes into meshing engagement with the ring gear, on the other hand, the leading end of the first projecting portion 6*a* of the rotation regulating member 230 comes out of the recess 213*a* of the flange 213 into the rear end side of the retraction regulating member 5 thereby to release the rotational regulation of the pinion 200.

When the main movable contact 612 then comes into abutment against the fixed contact 49, the starting resistor 617 is short-circuited to apply the rated voltage to the starter motor 500 thereby to rotate the armature 540. As a result, this rotation of the armature 540 is transmitted through the planetary gear speed reduction mechanism to the output shaft 220 so that the pinion 200, as released from its rotational regulation, can be rotated by the output shaft 220 to rotate the ring gear thereby to start the engine.

When the pinion 200 advances to mesh with the ring gear, the urging force of the spring 240, as arranged at the leading end side of the pinion 200, is increased. After the engine start, moreover, the rotating force of the engine is caused to retract the pinion 200 by the action of the helical spline when the pinion 200 is rotated by the ring gear. By these forces, the pinion 200 would be retracted with respect to the output shaft 220, but this retraction of the pinion 200 is regulated by the abutment of the first projecting portion **6*a* of the rotation regulating member 230 against the abutment portion 5*a* of the retraction regulating member 5 so that the pinion 200 can be prevented from retracting toward the armature 540**.

After this, when the starter switch is turned OFF to interrupt the energization of the coil 650 of the magnet switch 600, the magnetic force of the coil 650 disappears so that the plunger 610, which has been attracted till then to the stationary iron core 642, is returned to its initial position (i.e., downward of FIG. 19) by the urging force of the spring 46. When this plunger 610 restores its initial position, the force, by which the plunger 610 has been urged downward into abutment against the second projecting portion **6*b* of the rotation regulating member 230 through the connecting member 680, disappears so that the rotation regulating member 230 is returned to its initial position by the force of the return spring 41**.

At this time, the retraction regulating member 5 has its engagement recess **5*d* released from engagement with the first projecting portion 6*a* of the rotation regulating member 230, and the actuating portion 680*f* of the connecting member 680 comes out of the second projecting portion 6*b* of the rotation regulating member 230, so that the retraction regulating member 5 is released from its abutment. As a result, the pinion 200** for receiving the retracting force from the ring gear is returned to a rest position.

(Advantages)

The present embodiment is constructed such that the plunger 610 is moved to actuate the rotation regulating member 230 through the connecting member 680. This connecting member 680 constructed to include the moving portion **680*g* to be moved by moving the plunger 610, the actuating portion 680*f* for actuating the rotation regulating member 230 by abutting against the second projecting portion 6*b*, and the rotatable rod-shaped portion 680*h* connecting the moving portion 680*g* and the actuating portion 680*f* and so arranged radially outside of the armature 540 as extends generally in parallel with the shaft 510. In order to actuate the rotation regulating member 230, therefore, the rod-shaped portion 680*h* of the connecting member 680 is turned. As a result, unlike the first and second embodiments of the cord-shaped member, the rotation regulating member is prevented from coming out of the member supporting the cord-shaped member even with the warp of the cord-shaped member itself. Moreover, the actuating portion 680*f* of the connecting member 680 moves a predetermined stroke while abutting against the rotation regulating member 230 in accordance with the rotation of the rod-shaped member 680*h* of the connecting member 680 to actuate the rotation regulating member 230 thereby to regulate the rotation of the pinion 200. Thus, if the rotation regulating member 230 could not return from the position in which it is in abutment against the retraction regulating member 5, the actuating portion 680*f* of the connecting member 680 is only in abutment against the rotation regulating member 230 so that the pinion 200 can rotate by the extent for the actuating portion 680*f* of the connecting member 680 to have rotated the predetermined stroke. In other words, after the rod-shaped portion 680*h* of the connecting member 680 freely rotated, the plunger 610 restores its initial position so that the main movable contact 612 can leaves the fixed contact 49 whereas the auxiliary movable contact 611 leaves the starting resistor 617, which is electrically connected with the fixed contact 49, without fail thereby to prevent the malfunction of the magnet switch 600**.

In the first and second embodiments in which the rotation regulating member is actuated through the cord-shaped member, moreover, it is necessary to employ the pulley, which will cause the rotational loss. In order to compensate for this rotational loss, the attraction of the magnet switch 600 has to be increased to enlarge the structure of the magnet switch 600. In order to eliminate this, an expensive needle bearing has to be employed in the pulley. If the connecting member 680 is used, however, the pulley itself can be eliminated to reduce the attraction of and accordingly the size of the magnet switch 600.

When the cord-shaped member is made of such a soft material, it is hard to position when it is to be assembled by an automatic assembler. However, the connecting member 680, as used, has such a proper rigidity that it is easy to position, even when it is assembled by the automatic assembler, so that the assemblability is improved.

Moreover, the magnet switch 600 is arranged in the vicinity of the starter motor 500 at the axially opposite side to the pinion 200 and generally upright with respect to the shaft 510 of the armature 540, and the moving portion **680*g* and the actuating portion 680*f* of the connecting member 680 are bent from the two ends of the rod-shaped portion 680*h*. As a result, the plunger 610 is moved generally in the rotating direction of the rod-shaped portion 680*h* to turn the moving portion 680*g* on the axis of the rod-shaped portion 680*h* so that the actuating portion 680*f* is turned on the axis of the rod-shaped portion 680*h*. Thus, the attraction of the magnet switch 600 can be efficiently transformed into the turning force of the actuating portion 680*f* to actuate the rotation regulating member 230** smoothly.

Moreover, the rod-shaped portion of the connecting member 680 is supported by the bearings 61 and 62 so that it can be easily turned.

Since the connecting member 680 is a resilient member, moreover, it is so properly warped that the plunger 610 can be moved to a sufficient stroke when the pinion 200 starts to move to the ring gear by the regulation of the rotation by the rotation regulating member 230. As a result, even when the main movable contact 612, the auxiliary movable contact 611 and the fixed contact 49 are worn according to the lapse of years to enlarge the distances between the main and auxiliary movable contacts 50 and 52 and the fixed contact 49, they can be closed without fail to actuate the starter 1.

Moreover, the impact occurring when the pinion 200 meshes with the ring gear can be absorbed by the resiliency of the connecting member 680 so that it can be prevented from being transmitted to the plunger 610. As a result, the contacts can be reliably closed without any vibration of the plunger 610.

[SIXTH EMBODIMENT]

Figure 23:
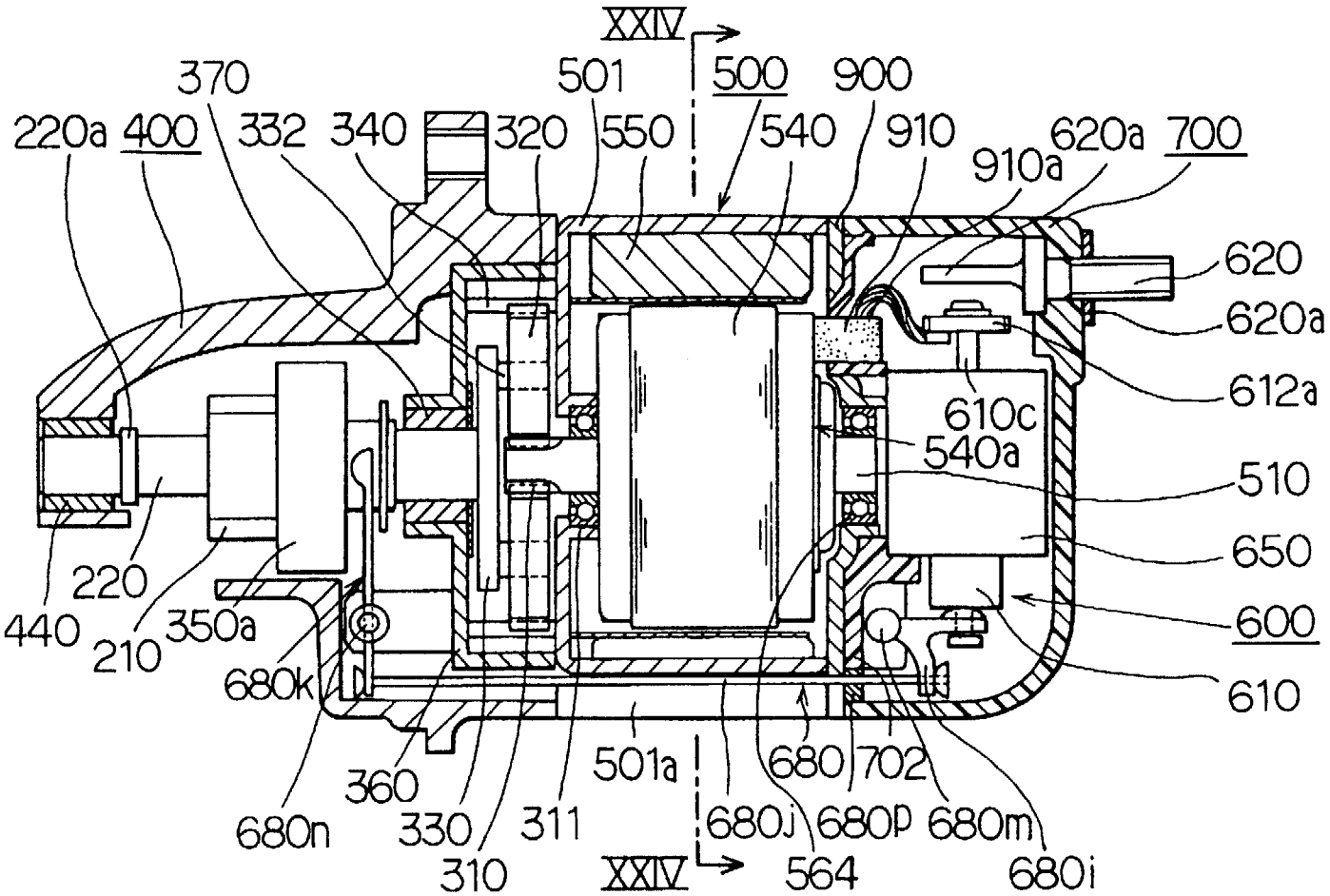
FIG. 23 is a sectional view showing the entirety of a starter according to a sixth embodiment.

In a sixth embodiment shown in FIG. 23, a starter motor 500 is constructed to include a cylindrical yoke 501 for holding a plurality of field magnetic poles 550 (e.g., permanent magnets) on its inner circumference, an armature 540 arranged in the inner circumference of the permanent magnet and rotatably supported at the two end portions of a shaft 510 by bearings 311 and 564, and brushes 910 (composed of a positive side brush and a negative side brush) for feeding an electric current to the armature 540.

The yoke 501 has a recess 501*a* formed over the entire length in the cylindrical direction and recessed toward the inner circumference partially in the circumferential direction. This recess 501*a* is formed, as shown in FIG. 24, between the two magnets 550 adjoining in the circumferential direction of the yoke 501.

The armature 540 has a face type commutator, of which the sliding face with the brush 910 is generally at a right angle with respect to the shaft 510.

The brush 910 is composed of the positive side brush connected through a lead wire 910*a* with a movable contact 612*a*, and the negative side brush connected through another lead wire with a metallic end plate 900 and electrically grounded to the ground.

The magnet switch 600 is so held by a solenoid holding member 702 that the actuating direction of a plunger 610 intersects the shaft 510 of the starter motor 500 generally at a right angle. With this solenoid holding member 702, moreover, there is integrally formed a brush holding portion for holding the brush 910.

The motor contact is composed of the movable contact 612*a* assembled at the end portion of the rod 610*c* through an insulating member (not shown), and a fixed contact 620*a* provided to correspond to the movable contact 612*a*.

The connecting member 680 is constructed to include a change lever 680*i*, a connecting rod 680*j* and a drive lever 680*k*.

The change lever 680*m* transmits the plunger attraction of the magnet switch 600 to the connecting rod and is made turnable on a fulcrum 680*m* which is supported by the solenoid holding member 702.

The connecting rod 680*j* transmits the plunger attraction, as transmitted through the change lever 680*i*, to the drive lever 680*k* by connecting the change lever 680*i* and the drive lever 680*k*. This connecting rod 680*j* is slidably supported by a support member 680*p*, which is sandwiched between the solenoid holding member 702 and the end cover 700, and is arranged generally in parallel with the shaft 510 and an output shaft 220 through the inside of a housing 400, the inside of the recess 501*a* formed in the yoke 501, and the inside of the end cover 700.

The drive lever 680*k* is made turnable on a fulcrum 680*n* which is supported by a center case 360 and transmits the plunger attraction of the magnet switch 600, as transmitted through the change lever 680*i* and the connecting rod 680*j*, to a one-way clutch 30 thereby to move the one-way clutch 350*a* and a pinion gear 210 in the axial direction.

(Operation)

When a starter switch is turned ON to energize the solenoid coil 650 of the magnet switch 600, the plunger 610 is attracted to move upward in FIG. 23 by the magnetic force of the solenoid coil 650. As a result, the rod 610*c* and the drive lever 680*k* are driven through the change lever 680*i* which is connected to the plunger 610, so that the one-way clutch 350*a* and the pinion gear 210 are moved toward the ring gear on the output shaft 220.

After this, the pinion gear 210 comes into meshing engagement with the ring gear so that the rotating force of the starter motor 500 is transmitted from the pinion gear 210 to the ring gear thereby to start the engine.

(Advantages)

Figure 25:
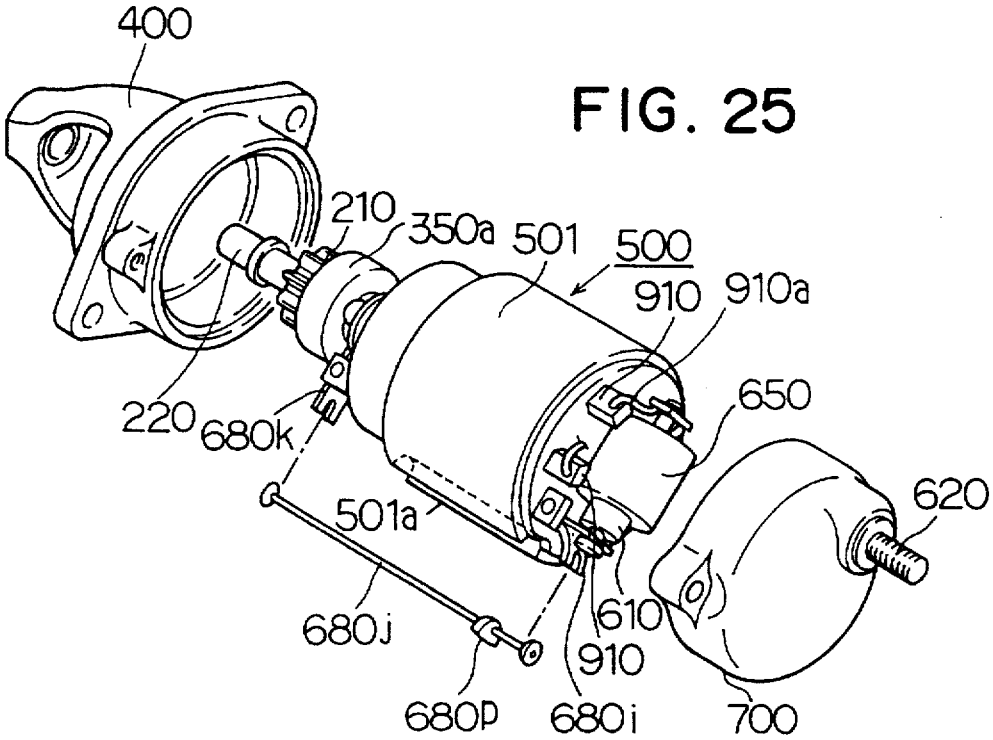
FIG. 25 is an exploded perspective view of the starter and shows a process for assembling a connecting rod.

In the present embodiment, as shown in FIG. 24, the connecting rod 680*j* is arranged outside of the yoke 501 and in the recess 501*a* so that the gaps between the adjoining permanent magnets 550, as fixed in the inner circumference of the yoke 501, need not be extended in the axial direction. As a result, the connecting rod 680*j* can be assembled from the outside of the yoke, as shown in FIG. 25, so that the assembly of the connecting rod 680*j* can be made far more easily than the case in which the connecting rod 680*j* is radially inside the yoke 501 to extend the gaps between the permanent magnets 550 in the axial direction. Since the connecting rod 680*j* is arranged in the recess 501*a* formed in the yoke 501, moreover, the connecting rod 680*j* is kept from jumping outward from the external diameter of the yoke 501 so that the radial expansion can be prevented.

(Modification)

Figure 26:
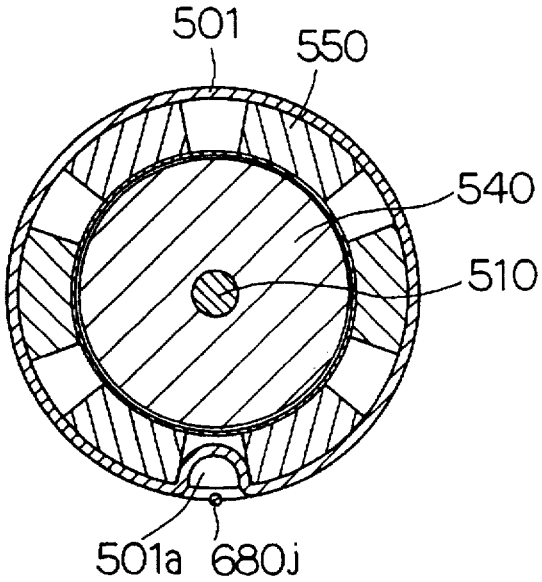
FIG. 26 is a sectional view of a yoke including a connecting rod in accordance with a modification of the sixth embodiment.

The connecting rod 680*j* arranged in the recess 501*a* need not be arranged in its entirety in the recess 501*a*, but its outer circumference may extend over the recess 501*a*, as shown in FIG. 26. Moreover, the recess 501*a* need not always be formed in the yoke 501, but the connecting rod 680*j* may be arranged outside of the external diameter of the yoke 501.

The connecting member 680 may be given another structure if this structure allows the plunger attraction of the magnet switch 600 to be transmitted to the one-way clutch 350*a* thereby to move the one-way clutch 350*a* and the pinion gear 210 in the axial direction. If there is used a return spring for returning the drive lever 680*k* when the magnet switch 600 is turned OFF, for example, such a flexible cord-shaped member as used in the first embodiment can be used in place of the rigid connecting rod 680*j*. When this cord-shaped member is used, moreover, its working direction may be changed by a roller or the like in place of the change lever 680*j*.

[SEVENTH EMBODIMENT]

Figure 27:
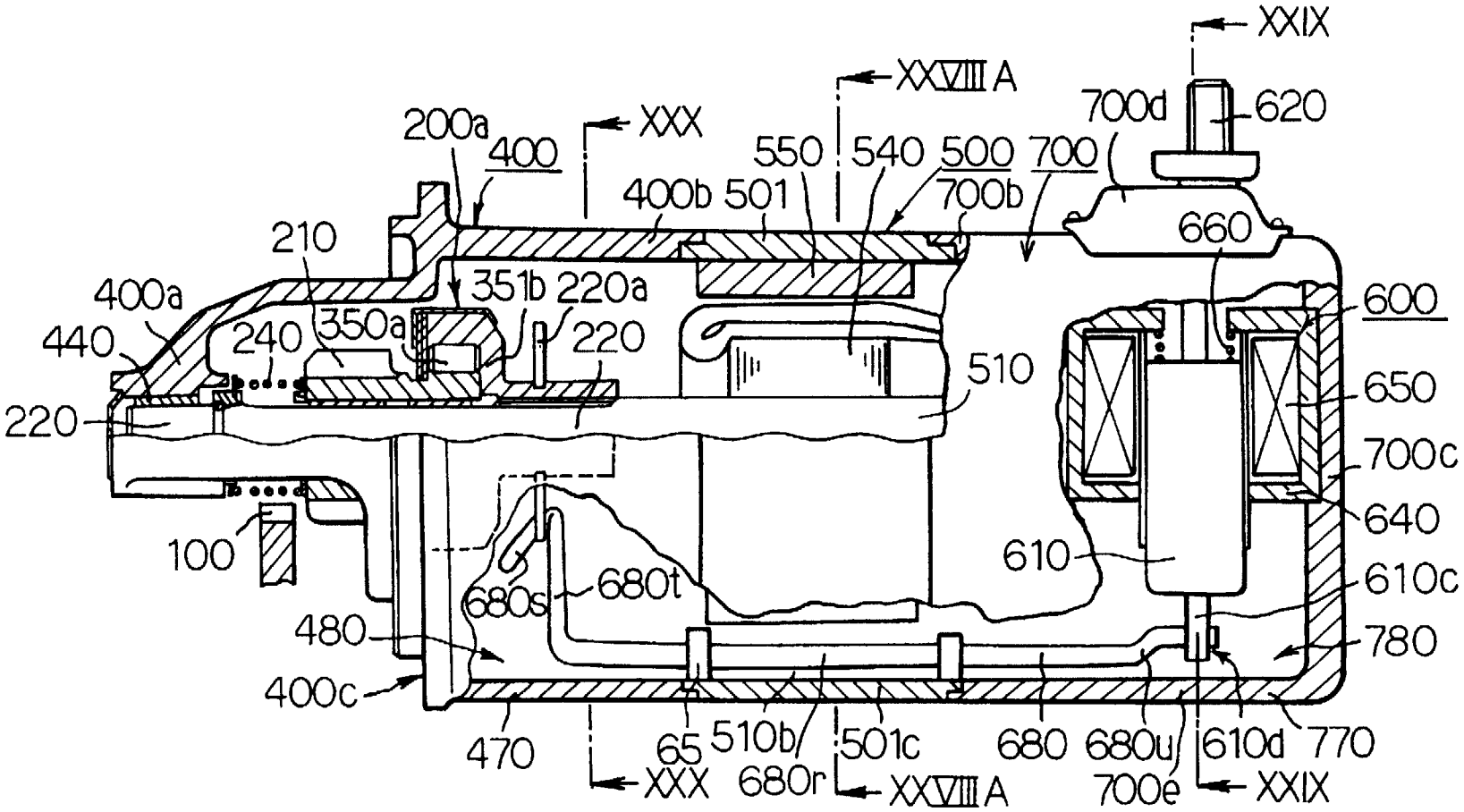
FIG. 27 is a sectional view showing a construction of a starter according to a seventh embodiment.

In a seventh embodiment shown in FIG. 27, a pinion moving member 200*a* is constructed to include a pinion gear 210, a one-way clutch 350*a* and a retainer washer 220*a*. The pinion moving member 200*a* is in engagement with the spline which is formed on the outer circumference of an output shaft 220 integrated with an armature shaft 510, so that it is so supported as to move along the output shaft 220 in the longitudinal or axial direction. The retainer washer 220*a* is a disc-shaped member having a through hole at its center. The retainer washer 220*a* is fixed on an outer member 351*b* of the one-way clutch 350*a* (or may be in rotatable engagement with the groove of the outer member 351*b*).

A housing 400 is cast of an aluminum alloy and forming the contour of the front portion of the starter, and its front end portion 400*a* supports the front end portion of the output shaft 220 rotatably through a bearing 440. The housing 400 is so fixed that its abutment portion, as formed to face the front, is fitted in abutment in the casing accommodating a ring gear 100 of an engine fly wheel. The moving member 200*a* is accommodated in the inside space of the housing 400.

Figure 28A:
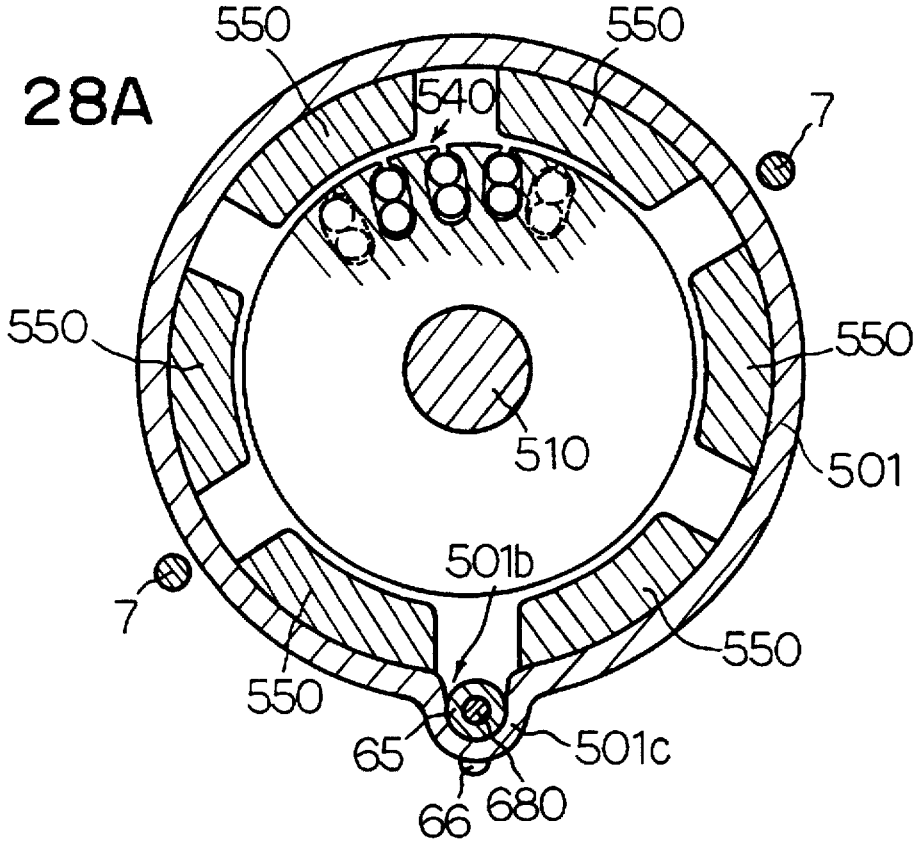
FIGS. 28A and 28B are side views showing a construction of bearings for a motor and an interlocking rod in accordance with the seventh embodiment and present an end face view along the rotary plane of the motor taken along XXVIIIA—XXVIIIA in FIG. 27 and a section showing a portion of a structure for mounting the bearing of the interlocking rod, respectively.

The motor 500 is constructed, as shown in FIGS. 27 and 28A, to include: a yoke 501 made of a soft magnetic material (e.g., soft iron) and a plurality of field magnetic poles 550 arranged in the inner circumference of the yoke 501; an armature 540 having an armature shaft 510 inserted at its center; and an end frame 700 made of aluminum and provided as a rear cover. The motor 500 is fitted, as shown in FIG. 27, on the rear end portion 400*b* of the housing 400 at the front end portion of the yoke 501 and on the front end portion 700*b* of the end frame 700 at the rear end portion of the yoke 501. The housing 400 and the end frame 700 are axially pressed and fastened to each other by means of through bolts 77 extending radial outside of the yoke 501.

In the inside space of the end frame 700, there is fixed and held with respect to the end frame 700 the magnet switch 600 which has a plunger 610 to be attracted by a magnetic coil 650 when energized.

The magnet switch 600 is arranged in such a direction that the shaft 510 of the motor 500 and the moving direction of the plunger 610 are at a right angle. The plunger 610 of the magnet switch 600 is fitted in and axially slidably held in a through bore which is formed at the center of the coil 650. This plunger 610 is attracted into the through bore of the coil 650, when this coil 650 is energized, and is returned to the protruded position by the resilient force of a return spring 660 when the same is deenergized.

Figure 29:
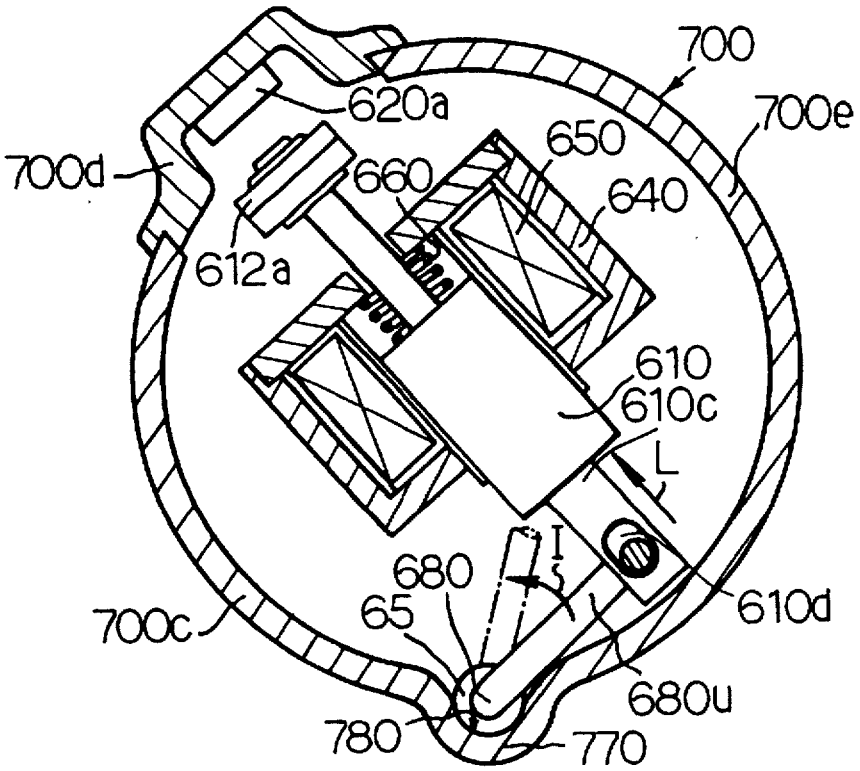
FIG. 29 is a side view showing the construction of the mechanism in an end frame taken along XXIX—XXIX in FIG. 27.

The plunger 610 holds a plunger rod 610*c* protruding at its lower end portion, as shown in FIG. 29, and the leading end portion of the plunger rod 610*c* has an engagement hole 610*d* extending therethrough in the longitudinal direction. In this engagement hole 610*d*, there is fitted the rear end portion of a crank-shaped actuated portion 680*u* of an interlocking rod 80 used as a connecting member 680.

At the upper end portion of the magnet switch 600, there are provided a movable contact 612*a* held at the upper end portion of the plunger 610, and a fixed contact 620*a* fixed on the end frame 700. This fixed contact 620*a* is connected through a terminal bolt 620 with an external circuit (e.g., a starting circuit connected with the positive electrode of the battery), whereas the movable contact 612*a* is connected through a lead wire (not shown) with a brush (not-shown) of the motor 500.

Figure 35A:
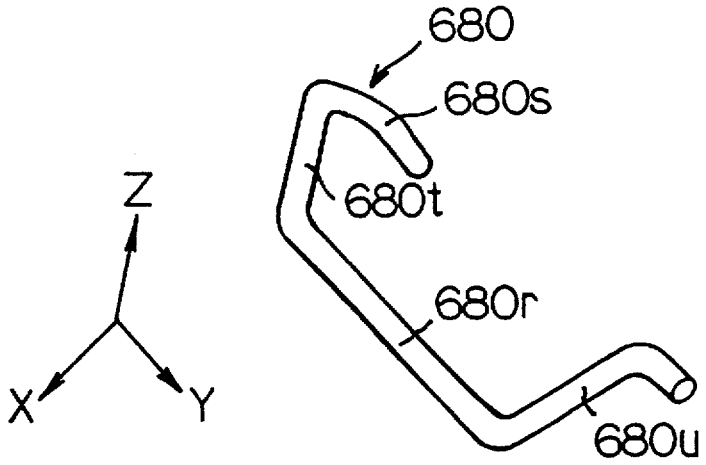
FIGS. 35A to 35C are assembly diagrams showing a stereoscopic rod according to a further modification of the seventh embodiment.

The axis of the plunger 610 of the magnet switch 600 is arranged at an inclination of about 45 degrees on the armature shaft 510 with respect to the direction of gravity. Thus, the terminal bolt 620 is arranged not above the starter, as conveniently shown in FIG. 27, but at an inclination, as shown in FIGS. 29 and 35A.

The magnet switch 600 is arranged in the end frame 700 forming the rear end of the motor 500 so that the drive force of the plunger 610 is transmitted through the interlocking rod 680 to move the pinion moving member 200*a* along the output shaft 220. As a result, the pinion gear 210 protrudes to mesh with the ring gear 100 so that it is driven through the output shaft 220 by the motor 500 to drive the ring gear 100 rotationally thereby to start the engine.

In this embodiment, there is provided no speed reduction gear mechanism so that the armature shaft 510 of the motor 500 and the output shaft 220 are in a single integral rotary shaft.

The interlocking rod 680 is a connecting member which is provided by bending a round rod of non-magnetic stainless steel, as shown in FIG. 27 and FIGS. 31A to 31D. Specifically, the interlocking rod 680 is composed of three portions: an actuating portion 680*t* to abut against the pinion moving member 200*a*; an intermediate portion 680*r* of a straight round rod; and an actuated portion 680*u* engaged with the plunger rod 610*c* of the magnet switch 600. The rod 680 has its intermediate portion accommodated along the inner circumference of the yoke 501 so that it is so retained as to rotate within a predetermined angular range.

Figure 28B:
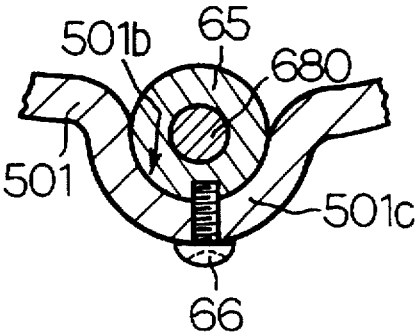

As shown in FIGS. 28A and 28B, more specifically, the yoke 501 has a longitudinal projection 501*c* formed in the longitudinal direction of the shaft 510. The projection 501*c* has its outer and inner circumferences projecting between the adjoining field magnets 550. The interlocking rod 680 has its intermediate portion 680*r* accommodated in a groove 501*b* which is formed by the inner circumference of the projection 501*c* of the yoke, so that it is held to rotate within the predetermined angular range.

Figures 31A, 31B, 31C, 31D:
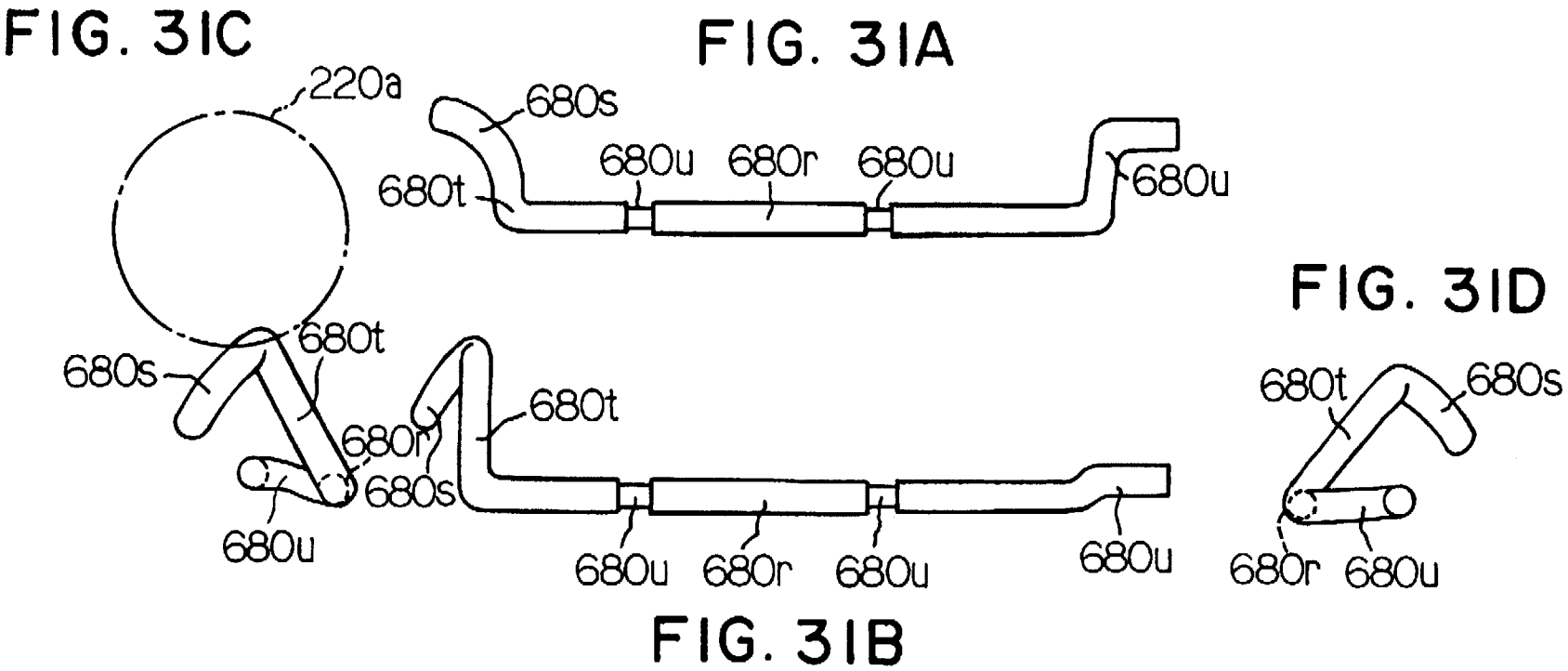
FIGS. 31A to 31D are assembly diagrams showing a stereoscopic shape of the interlocking rod.
Figure 32:
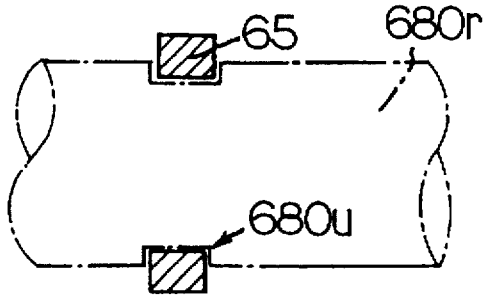
FIG. 32 is a sectionnal view showing a portion of the structure for fitting the interlocking rod and a bearing.

As best shown in FIGS. 31A and 31B, the intermediate portion 680*r* of the rod 680 has two longitudinal portions 680*u* which are diametrically reduced from the adjoining portions. Further as shown in FIG. 32 and FIGS. 28A and 28B, the rod 680 is rotatably supported by a pair of bearings 65 which are fitted on the diametrically reduced portions 680*u* of the intermediate portion 680*r*. Moreover, these individual bearings 65 are so fixed by means of screws 66 as to contact with the inner circumferences of the grooves 501*b* of the front end portion and the rear end portion of the yoke 501. This fixing can be effected not only by using the screws 66 but also by caulking the edges of the grooves 501*b* to fix the individual bearings 65 and by welding the individually bearings 65 to the grooves 36 fixedly.

Figure 30:
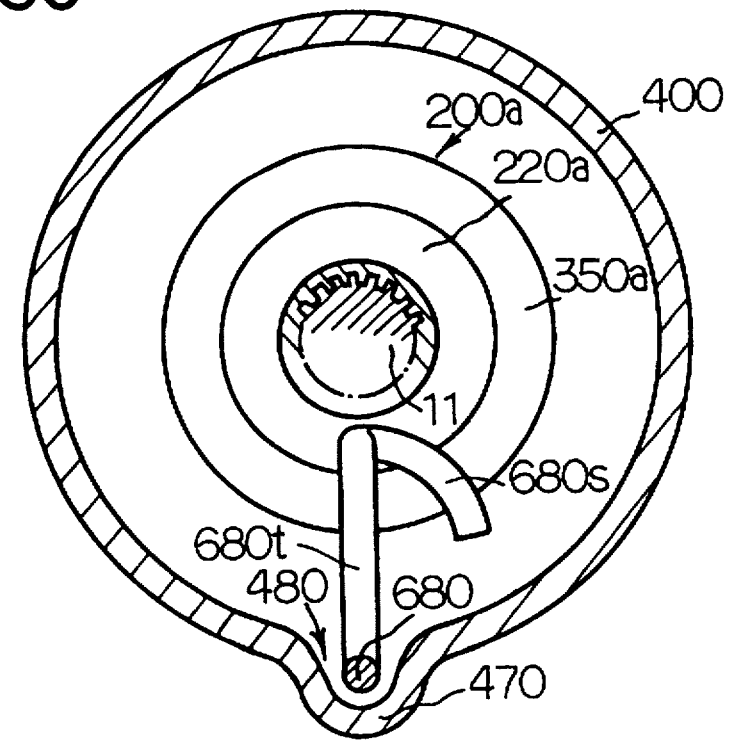
FIG. 30 is an end face view showing the construction and operation of the mechanism in a housing taken along XXX—XXX.

As shown in FIGS. 29 and 30, on the other hand, both the end frame 700 and the housing 400 have projections 770 and 470 which form grooves 780 and 480 leading to the grooves 501*b* in the inner circumference of the projection 501*c* of the yoke 501. In the grooves 780 and 480 formed by the projections 770 and 470, there are individually accommodated a portion of the actuating portion 680*t* and a portion of the actuated portion 680*u* of the rod 680. The bearing 65 of FIG. 29 is jointed to the yoke 501 and is so drawn as can be seen from the end face of the Figure.

As described hereinbefore, the interlocking rod 680 is rotatably supported on the axis of the intermediate portion 680*r*, and the crank-shaped actuated portion 680*t* of the interlocking rod 680 is inserted to engage with the engagement hole 610*d* of the plunger rod 610*c* at the rear end portion which is spaced at a predetermined distance from the axis of the intermediate portion 680*r*. As shown in FIG. 29, therefore, a straight movement L of the plunger 610 is transformed into a rotational motion I around the axis of the intermediate portion 680*r* thereby to displace the rod 680 rotationally.

As shown in FIG. 30, the actuating portion 680*t* of the interlocking rod 680 has a helical front end portion 680*s* around the axis of the intermediate portion 680*r* so that the front end portion 680*s* rotates around the axis of the intermediate portion 680*r* when the rod 680 rotationally is driven. Then, the front end portion 680*s* abuts from the back against the retainer washer 220*a* of the pinion moving member 200*a*, and the retainer washer 220*a* is pushed forward so that the interlocking rod 680 moves the pinion moving member 200*a* forward.

(Assembling Process)

The process for assembling the starter of the present embodiment will be described with particular respect to the assembly of the interlocking rod 680.

First of all, the intermediate portion 680*r* of a straight round rod of stainless steel or the material for the rod 680 is cut by a lathe or the like to form the two diametrically reduced portions 680*u*. The rod 680 is then inserted into the through holes of the two bearings 65, and these bearings 65 are pressed in and clamped respective whole circumference through the intermediate portion 680*r* so that those are diametrically reduced and fitted on the diametrically reduced portions 680*u* of the intermediate portion 680*r*. With the bearings 65 being individually held on the radially reduced portions 680*u*, the round rod is then bent but for the intermediate portion 680*r* to form the actuating portion 680*t* and actuated portion 680*u*. After this, the screws 66 are driven to fix the individual bearings 65 on the projection 501*c* of the yoke 501. The bearing 65 could be modified into a structure in which it is split into halves. In this structure, the bearing 65 need not be clamped.

Next, the end frame 700, as having the magnet switch 600 assembled in advance therein, is jointed to the stepped rear end portion of the yoke 501 with the plunger 610 and the rod 680 engaging with each other. Specifically, the rear end portion of the actuated portion 680*u* of the rod 680 is inserted to engage with the engagement hole 610*d* of the plunger rod 610*c* of the magnet switch 600, and the stepped front end portion 700*b* of the end frame 700 is jointed to the stepped rear end portion of the yoke 501 while keeping the engagement. Moreover, the stepped front end portion of the yoke 501 is jointed to the stepped rear end portion 400*b* of the housing 400 so that the end frame 700 and the housing 400 are fastened through the yoke 501 by means of two through bolts 7, as located diagonally to each other. Then, the front end portion 680*s* of the actuating portion 680*t* of the rod 680 comes from the back into abutment against the retainer washer 220*a* of the pinion moving member 200*a*, thus completing the assembling process.

(Advantages)

According to the present embodiment, at first, the magnet switch 600 is arranged in the end frame or the rear cover 700 of the motor 500, and the rod 680, as engaging with the plunger rod 610*c* and interlocking with the pinion moving member 200*a*, is arranged from the end frame 700 to the housing 400. In the rod 680, the actuating portion 680*t*, the intermediate portion 680*r* and the actuated portion 680*u* are mounted in the housing 400, the yoke 501 and the end frame 700, respectively, so that the rod 680 has no portion exposed to the radial outside of the housing 400, yoke 501 and end cover 700. Moreover, the interlocking rod 680 is held rotatably on the axis of the intermediate portion 680*r* by the bearings 65 so that the drive force from the plunger 610 of the magnet switch 600 is transmitted through the rotational motion of the interlocking rod 680 thereby to move the pinion moving member 200*a*.

Moreover, the rod 680 is not exposed to the outside radially, and the through holes for guiding the rod 680 to the outside is not formed in the members (including the housing 400, the yoke 501 and the end frame 700) forming the contour of the starter. Thus, there is achieved another effect to prevent any muddy water or dust from invading the inside of the starter.

According to the starter of the present embodiment, there can be achieved the effects to eliminate the designing disadvantages, as might otherwise come from the arrangement of the magnet switch 600, and to reduce the malfunction of the pinion moving member 200*a* thereby to prevent the invasion of the muddy water or dust.

Secondly, the yoke 501 of the motor 500 has the projection 501*c* formed in the longitudinal direction between the field magnetic poles 550 adjoining each other. Moreover, the intermediate portion 680*r* of the rod 80 is mostly accommodated in the groove 501*b* of the projection 501*c* of the yoke 501 so that it will not clog the space between the adjoining field magnetic poles 550. As a result, there can be attained an effect to prevent the intermediate portion 680*r* of the rod 680 from obstructing the cooling of the field magnetic poles 550 and from exerting the magnetic influence upon the field.

Thirdly, not only the yoke 501 forms the projection 501*c*, but also the housing 400 and the end frame 700, as individually jointed to the front and back of the yoke 501, form their individual projections 470 and 770. Specifically, the grooves 501*b*, 780 and 480 lead straight to one another, and a portion of the actuating portion 680*t* and a portion of the actuated portion 680*u* of the interlocking rod 680 are respectively accommodated in the groove 400 of the projection 470 of the housing 400 and in the groove 780 of the projection 770 of the end frame 700.

Therefore, the rod 680 can form the rod-shaped straight portion over the entire length of the yoke 501. This construction is advantageous when the bearings 65 are fixed unlike the present embodiment in the housing 400 and the end frame 700. In addition, the bending moment or the twisting moment to be applied to the actuating portion 680*t* or the actuated portion 680*u*, as located at a radial distance from the axis of rotation of the intermediate portion 680*r*, is lightened so that the stress or strain to be established in the rod 680 can be reduced to lighten the interlocking rod 680. Therefore, there can be achieved an effect not only to facilitate the arrangement of the rod 680 but also to lighten the rod 680.

Fourthly, the magnet switch 600 is arranged to intersect the shaft 510 at a right angle. Reverting again to FIG. 29, when the magnet switch 600 operates to move the plunger 610 straight, the actuated portion 680*u*, as engaging with the plunger rod 610*c*, rotates around the axis of the intermediate portion 680*r* because it is eccentric to the axis of the intermediate portion 680*r*. Then, the actuating portion 680*t* of the rod 680 integrally rotates, as shown in FIG. 30, to push and move the pinion moving member 200*a* forward with the front end portion 680*s* which is formed helically around the intermediate portion 680*r*. As a result, the pinion gear 210 is protruded to the position in which it meshes with the ring gear 100.

According to the present embodiment, therefore, the magnet switch 600 is arranged at a right angle with respect to the shaft 510. As a result, there can be achieved an effect to make the starter more compact without elongating the starter so much. Since the magnet switch 600 is accommodated in the end frame 700, moreover, there can be achieved an effect to protect the magnet switch 600.

Fifthly, the intermediate portion 680*r* of the rod 680 have the two diametrically reduced portions 680*u*, at which the rod 680 is supported through the individual bearings 65 which are fixed in the groove 501*b* of the projection 770 of the yoke 501.

According to the starter of the present embodiment, therefore, the intermediate portion 680*r* of the rod 680 are supported by the two bearings 65 so that the friction which accompanies the rotating motion of the rod 680 is reduced to smooth the rotating motion of the rod 680. Moreover, the inner circumferences of the grooves 480, 501*b* and 780 of the housing 400, the yoke 501 and the end frame 700 are spaced at the predetermined distance from the rod 680 so that they are kept from contacting with each other to make no obstruction to the rotating motion of the rod 680. As a result, there is achieved an effect to smooth the action of the interlocking rod 680 thereby to enhance the reliability of the movement of the pinion moving member 200*a* by the rod 680.

Sixthly, the rod 680 is made of non-magnetic stainless steel so that it will neither receive the magnetic force to be generated by the alternately and abruptly fluctuating field magnetic field nor be vibrated by the magnetic field.

According to the starter of the present embodiment, therefore, the interlocking rod 680 is not vibrated by the magnetic field so that it is prevented from undesirably colliding against any surrounding member, thus raising an effect to improve the reliability.

(Modifications)

Figure 33:
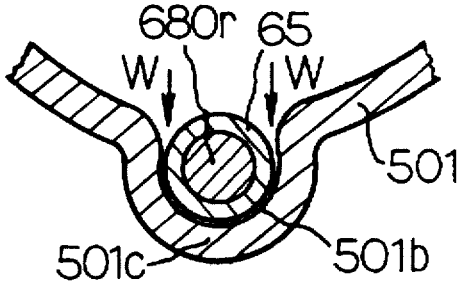
FIG. 33 is a partial sectional view showing a portion of the structure for mounting a bearing according to a modification of the seventh embodiment.

Fixing the bearings 65 on the projection 501*c* can be modified from the screws 66 (FIG. 28B) into the adoption of welding W, as shown in FIG. 33. In this modification, the bearings 65 need neither be internally threaded nor be positioned in the holes so that the starter can be manufactured at a lower cost.

Figure 34:
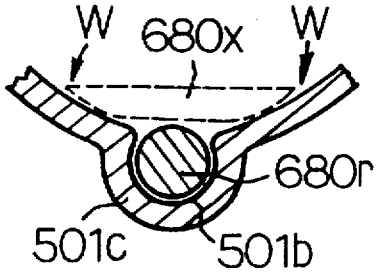
FIG. 34 is a partial sectional view showing a portion of the structure for mounting an interlocking rod according to another modification of the seventh embodiment.

In place of the bearings 65, the intermediate portion of interlocking rod 680 can be held directly by a groove 501*b*, as shown in FIG. 34. In this modification, the groove 501*c* is given a smaller internal diameter than that of the groove 501*c* shown in FIGS. 28B and 34 so that the groove 501*c* is loosely fitted at its inner circumference to have direct abutment against the intermediate portion 680*r* of the interlocking rod 680. The edges of the groove 501*c* are made so slightly narrower as to fit the intermediate portion 680*d* of the interlocking rod 680 loosely while preventing it from coming out. If a stopper 680*x* is welded at two portions across the opening of the groove 501*c*, the interlocking rod 680 is held more reliably.

Figure 35B:
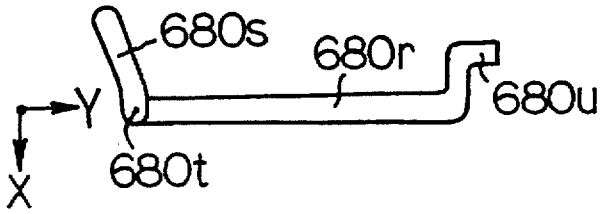
Figure 35C:
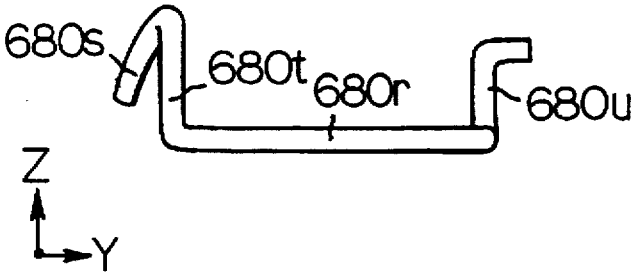

On the other hand, the rod 680 has no diametrically reduced portion 680*u* in the intermediate portion 680, as shown in FIGS. 35A to 35C, so that the interlocking rod 680 can be improved in strength and rigidity.

Figure 36A:
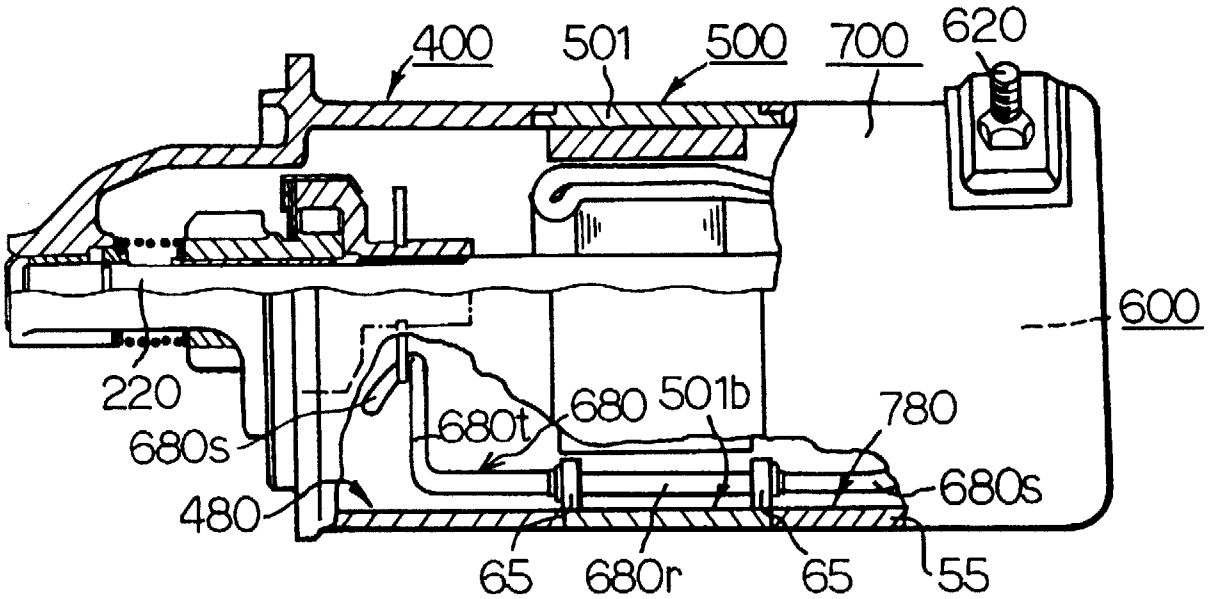
FIGS. 36A and 36B are assembly diagrams showing a construction of the motor and the interlocking rod according to a further modification of the seventh embodiment.
Figure 36B:
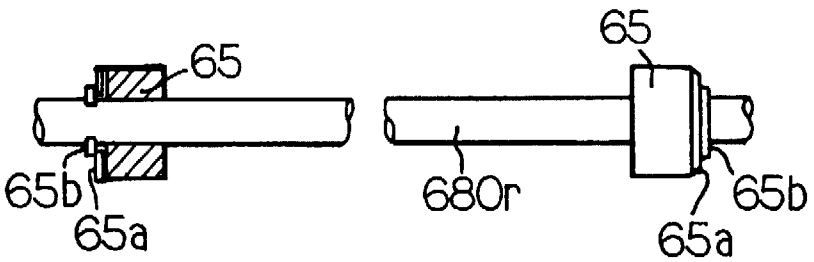

The construction can be modified from that using the bearings 65 into one adopting the interlocking rod 680 having no diametrically reduced portion 680*u*. In this modification, as shown in FIG. 36A, the intermediate portion 680*r* of the interlocking rod 680 is supported at two portions by the bearings 65, which are fixedly welded to the inner circumferences of the front and rear end portions of the groove 501*b* of the protrusion 501*c* of the yoke 501. On the intermediate portion 680*r*, there are arranged a thrust washer 65*a* and a cisclip 65*b* which are positioned at the opposed sides of the individual bearings 65 and act as stopper rings.

In this modification, the intermediate portion 680*r* of the interlocking rod 680 needs no diametrically reduced portion, but the washer 65*a* and stopper rings 65*b* are fixed longitudinally adjacent to each other on the intermediate portion 680*r* of the interlocking rod 680. Specifically, the longitudinal movement of the interlocking rod 680 is regulated by the actions of the stopper rings 65*b*, thus raising an effect to position the interlocking rod 680 stably. With no diametrically reduced portion in the rod 680, there is achieved another effect that the rod 680 can be made lighter and stronger.

In addition to the projections 501*c*, 470 and 770, another set of projections for receiving the through bolts 7 can be formed partially on the yoke 501, the housing 400 and the end frame 700. In this modification, the through bolts 7 are not exposed to the outside, thus raising an effect to simplify the surface treatment such as the corrosion prevention and the handling by the worker.

Alternatively, similar effects can be achieved by another modification in which the through bolts 7 are threaded between the field magnetic poles 550 inside the yoke 501 while omitting the projections therefor.

In another modification, the projection 501*c* is eliminated from the yoke 501, and the intermediate portion 680*r* of the interlocking rod 680 is threaded between the adjoining field magnetic poles 550 which are fixed on the inner circumference of the yoke 501. In this modification, a groove, as cut shallow, is extended in parallel with the armature shaft 510 in the inner circumference of the yoke 501 between the field magnetic poles 550 adjoining each other.

In another modification, in addition to the groove for the interlocking rod 680, there can be formed a groove for threading the through bolts 7 between the adjoining field magnetic poles 550 which are fixed on the inner circumference of the yoke.

This groove is also formed by the cutting operation so that the projection 501*c* is not left on the outer circumference of the yoke 501. The through bolts 7 are fitted by halves across their planes of symmetry in that groove so that their half capacities below their necks are buried in the groove. The through bolts 7 are made of a soft magnetic material like the yoke 501 to compensate for such a reduction in the thickness of the cylindrical wall of the yoke 501, as is caused by the groove, so that the the function of yoke as the paths for the magnetic lines of force is not deteriorated. Moreover, the through bolts 7 are buried by halves in the inner circumference of the yoke so that they will not clog the space so much between the field magnetic poles adjoining each other thereby not to deteriorate the cooling operation in the internal space of the motor.

Moreover, the through bolts 7 are not exposed to the outside of the yoke, but the yoke has a substantially complete cylindrical outer circumference, thus raising another effect that the starter can be made more compact.

[EIGHTH EMBODIMENT]

Figure 37:
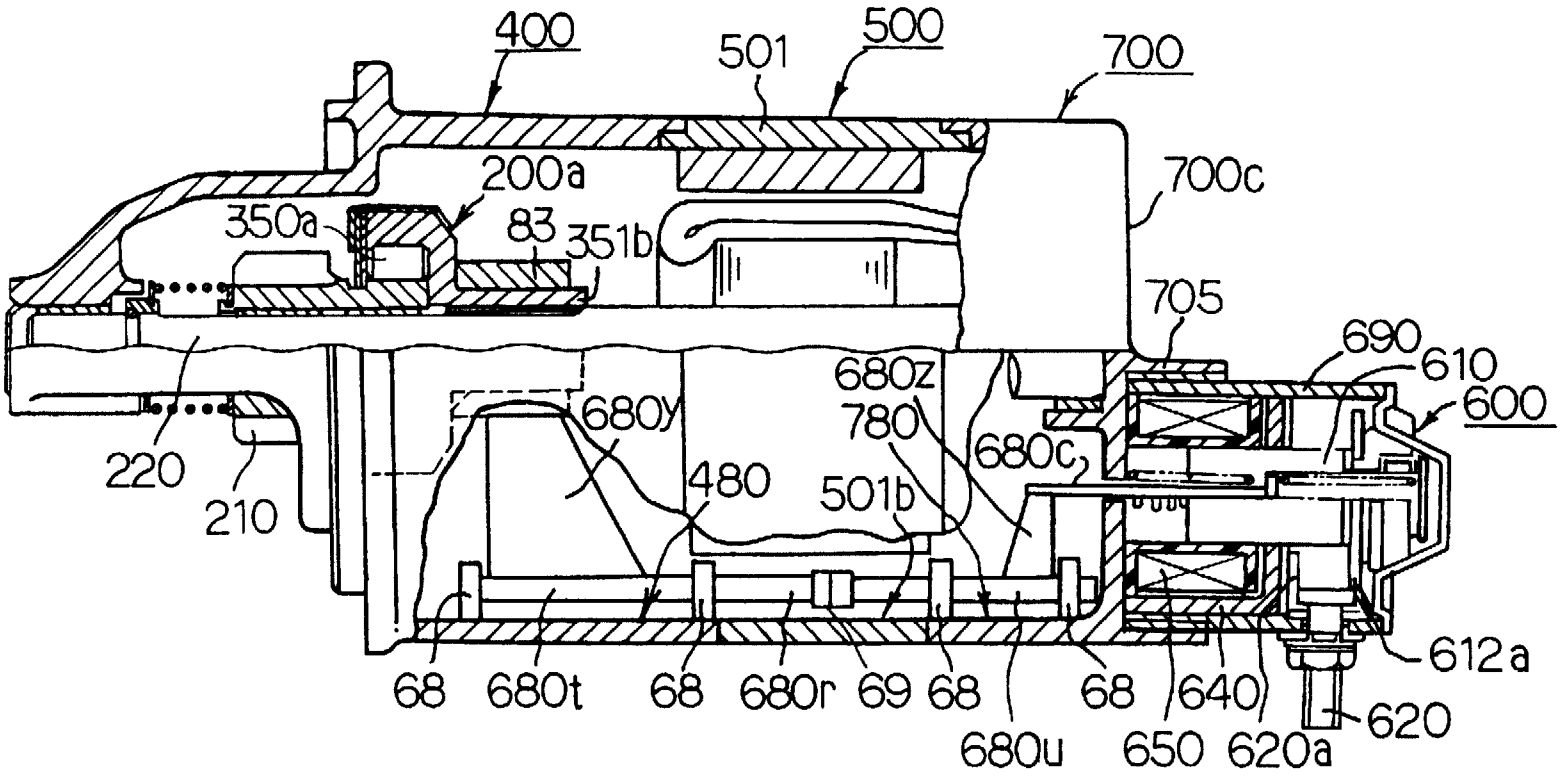
FIG. 37 is a sectional side view showing a construction of a starter according to an eighth embodiment.

In an eighth embodiment shown in FIG. 37, a magnet switch 600 is arranged in such a direction that an armature shaft 510 of a motor 500 and a plunger 610 move in parallel with each other.

Moreover, a movable contact 612*a* is fixed to the rear end portion of the plunger 610, and a fixed contact 620*a* is fixed to an outer cylinder member 690 forming a cylindrical side face of the magnet switch 600. These movable contact 612*a* and the fixed contact 620*a* form a main switch. The fixed contact 620*a* is connected with a terminal bolt 620 protruding from the magnet switch 600 radially. This terminal bolt 620 can be arranged in any direction in connection with the arrangement of the starter.

The outer cylinder member 690 is externally threaded in the outer circumference of its head so that it is fastened in the female thread which is formed in the inner circumference of a cylindrical mounting portion 705, as formed to project backward from the end plate of an end frame 700. Thus, the magnet switch 600 is fixed on the end frame 700. Since the mounting portion 705 is formed in a position to be confined by the outer circumference of the motor 500, the axial side end area of the starter is not increased by the magnet switch 600.

On the other hand, an interlocking rod 680 is constructed by a straight round rod of non-magnetic stainless steel having a predetermined length and is accommodated in the grooves 480, 501*b* and 780 which are continuously formed, as in the seventh embodiment, in the housing 400, the yoke 501 and the end frame 700. The rod 680 is welded by four holding portions, i.e., actuating portion 680*t*, two intermediate portions 680*r* and an actuated portion 680*u*, respectively, to the inner circumference of the groove 480 of the housing 400 and the inner circumference of the groove 780 of the end frame 700. Each holding member 68 is a hollow cylindrical sliding member, and the interlocking rod 680, as inserted into the through bore of the sliding member 68, is so held as to slide in the longitudinal direction by each holding member 68. Grease is applied to the sliding face of the rod 680.

This rod 680 is welded at its actuated portion 680*u* to the leading end portion of a plunger rod 610*c* through a connecting member 680*z* or a trapezoidal plate member so that it is so interlocked with the straight movement of the plunger rod 610*c* as to move in parallel.

On the other hand, the actuating portion 680*t* of the rod 680 is also jointed or welded to a connecting member 680*y* or the trapezoidal plate member. Likewise, the connecting member 680*y* and a cylindrical member 83 are integrally fixed to each other by welding. The inner circumference of the cylindrical member 83 is loosely fitted on the outer circumference of the rear cylindrical portion of the outer member 351*b* of a clutch 350*a*, and the front end face of the cylindrical member 83 is in abutment against the back face of the disc-shaped portion of the outer member 351*b* of the clutch 350*a*. Grease is applied to the sliding faces of the cylindrical member 83 and the outer member 351*b* of the clutch 350*a*.

(Assembling Process)

The rod 680 is manufactured such that it is longitudinally divided across connectors 69 fixed on the middle of the intermediate portion 680*r*. The connectors 69 have an action to fit and joint naturally, when the divided portions are brought into abutment, so that they are not separated even if a tension is merely applied.

The assembling process of the starter of the present embodiment is begun by separately assembling the housing 400, which is assembled with the front half of the rod 680, and the housing 400, which is assembled with the rear half of the rod 680 and the magnet switch 600.

Here will be described at first the assembling process of the housing 400. Prior to the assembly of the housing 400, the actuating portion 680*t* of the interlocking rod 680, the connecting member 69 and the cylindrical member 351*b* are welded to one another. In addition, the intermediate portion 680*r* of the interlocking rod 680, as located at the back of the connecting member 680*y*, is inserted into the holding members 68, and the connectors 69 are jointed and fixed at its one side to the rear end of the front half of the interlocking rod 680. After this, when the pinion moving member 200*a* and the output shaft 220 are to be assembled in the housing 400, the cylindrical member 83 is fitted on the outer member 351*b*, and the two holding members 68 are welded and fixed to the front portion and the rear portion of the groove 480.

Simultaneously with this, the end frame 700 is assembled. Prior to this assembly, the actuated portion 680*u* of the interlocking rod 680 and the connecting plate 680*z* are welded to each other. Moreover, the interlocking rod 680, as located in front of the connecting plate 680*z*, is inserted into the connecting members 68, and the other connector 69 is jointed and fixed to the front end of the rear half of the interlocking rod 680*r*. The magnet switch 600 is fixed on the mounting portion 705 at the rear end of the end frame 700, and the upper side of the connecting plate 680*z* is welded to the leading end portion of the plunger rod 610*c*, as protruded from the end plate into the internal space. Then, the connecting plate 680*z*, the rear half of the interlocking rod 680 and the plunger rod 610*c* are fixed on one another so that the rear half of the interlocking rod 680 is so interlocked with the plunger 610 as to move in the longitudinal direction.

Finally, when the housing 400 and the end frame 700 are to be jointed across the motor 500, one and the other of the connectors 69 are brought into abutment and fitted one on the other, and the front and rear halves of the interlocking rod 680 are connected to joint the rod 680 integrally. In this state, the housing 400 and the end frame 700 are fastened by means of through bolts (not shown), thus generally completing the assembly of the starter.

(Advantages)

Firstly, the axis of the plunger 610 of the magnet switch 600 is arranged in parallel with the shaft 510 of the motor 500. Moreover, the interlocking rod 680 is so slidably held by the holding members 68 that it can move in parallel with the shaft 510 of the motor 500. The actuated portion 680*u* of the interlocking rod 680 is in engagement with the plunger rod 610*c*, and the actuating portion 680 t is in abutment against the pinion moving member 200*a* through the connecting plate 680*y* and the cylindrical member 83. As a result, when the magnet switch 600 operates to protrude the plunger 610 forward, the interlocking rod 680, as jointed to the actuated portion 680*u* through the plunger rod 610*c* and the connecting plate 680*z*, also moves forward in parallel with the shaft 510 of the motor 500 so that the pinion moving member 200*a* is pushed forward by the actuating portion 680*t*. As a result, the pinion moving member 220*a* is moved forward by the interlocking rod 680, and the pinion gear 210 is protruded to mesh with the ring gear so that the ring gear is rotationally driven by the rotating force of the motor 500 thereby to start the engine.

More specifically, the magnet switch 600 is arranged in parallel with the shaft 510 of the motor 500 so that the interlocking rod 68 moves in parallel to push the pinion moving member 220*a* thereby to start the engine. As compared with the seventh embodiment in which the pinion moving member 220*a* is pushed through the rotation of the interlocking rod 680, therefore, there can be achieved an effect that the operation is more simplified to enhance the reliability. Unlike the seventh embodiment, moreover, the interlocking rod 689 is the straight round member and is so simple as to provide an effect that the construction can be simplified to lower the cost.

Secondly, the interlocking rod 680 is so held at the totally four portions, i.e., at the front and rear portions of the intermediate portion 680*r* and at the front and rear end portions of the interlocking rod 680 by the holding members 68 that it can slide in the longitudinal direction.

As a result, the interlocking rod 680 is supported at the four portions by the holding members 68 so that its friction with the holding members 68, when it linearly slides, is reduced to smoothen the linear sliding motions. Moreover, any portion of the interlocking rod 680 is kept at a predetermined distance away from the inner circumferences of the grooves 480, 501*b* and 780 so that the motion of the interlocking rod 680 is not obstructed. As a result, the motion of the interlocking rod 680 is so smooth as to provide an effect that the reliability is further enhanced.

Thirdly, the individual connections between the pinion moving member 220*a* and the plunger rod 610*c*, and the interlocking rod 680 are effected by using the highly rigid connecting member 680*y* and connecting plate 680*z*, and the interlocking rod 680 is less likely to buckle because it is supported at the four portions. Thus, there can be achieved an effect that the pinion moving member is highly rigid and hard to break even when it is subjected to an excessive backward force at the time of using the starter.

(Modifications)

In the eighth embodiment, the connecting plate 680*z*, the connecting member 680*y* and the cylindrical member 83 are provided for connecting the interlocking rod 680 and the pinion moving member 200*a* and the plunger rod 610*c*. However, the present embodiment can be modified into a simple construction in which those members are not adopted.

Figure 38:
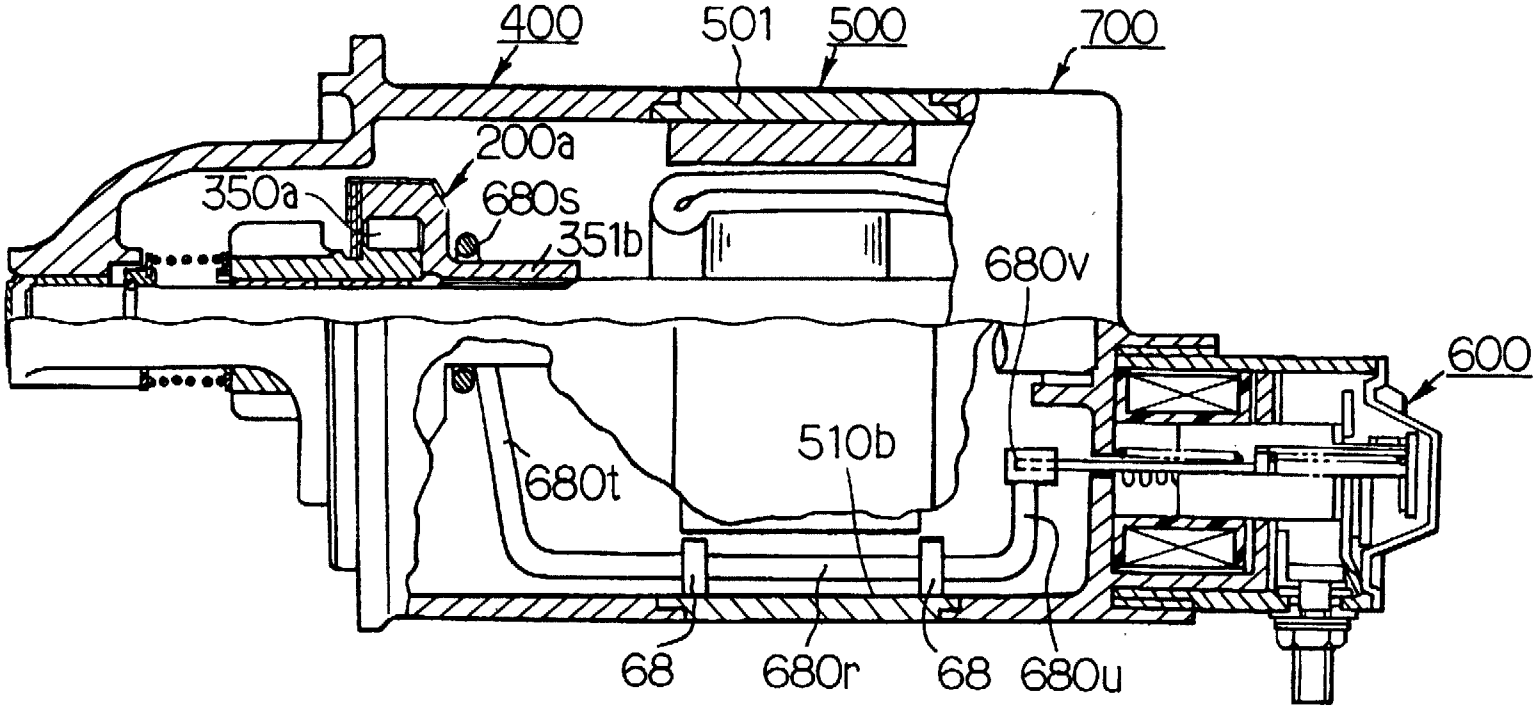
FIG. 38 is a sectional side view showing a construction of a starter according to a modification of the eighth embodiment.

In this modification, as shown in FIG. 38, an interlocking rod 680 is made of a round rod member of non-magnetic stainless steel, and its intermediate portion 680*r* is formed into a straight shape having neither the diametrically reduced portion nor the connectors 69. The intermediate portion 680*r* is held at the front and rear end portions of the yoke 501 by the holding members 68 which are welded to the inner circumference of the groove 501*b* of the yoke 501.

The actuating portion 680*y* of the interlocking rod 680 is bent upward in its midway, and its front end portion 680*s* is formed into an arcuate shape having a predetermined curvature and is wound on the boundary between the disc-shaped portion and the cylindrical portion of the outer member 351*b*. On the other hand, the actuated portion 680*u* of the interlocking rod 680 is bent upward in its midway so that a bottomed cylindrical member 680*v* is welded to the upper end of the actuated portion 680*u* and so that the leading end of the plunger rod 610*c* is inserted into and is jointed and fixed to the cylindrical member.

In the process for assembling the starter of the present modification, the rod 680 still having the straight shape is inserted at first into the two holding members 68 and is then bent into the shape shown in FIG. 38. At the same time, the bottomed cylindrical member is welded to the end face of the actuated portion 680*u*, thus providing the interlocking rod 680. Then, the holding members 68 are welded to the individual inner circumferences of the front and rear end portions of the groove 510*b* of the yoke 501 so that the interlocking rod 680 is so held in the yoke 501 as to slide axially. After this, the end frame 700 is jointed to the motor 500, and the leading end of the plunger rod 610*c* is then inserted and jointed to the hole which is opened in the back of the bottomed cylindrical member 680*v*. In addition, the housing 400, in which are inserted the pinion moving member 200*a* and the output shaft 220, is jointed to the motor 500, and the front end portion 680*s* of the interlocking rod 680 is then brought into engagement with the outer member 351*b* of the pinion moving member 200*a*, thus completing the assembling process.

The present modification takes the step of bending the interlocking rod 680 but does not adopt any member other than the bottomed cylindrical member 680*v* for connecting the pinion moving member 200*a* and the plunger rod 610*c*. Thus, the interlocking rod 680 and its peripheral construction are drastically simplified with the low parts cost and the reduced number of assembling steps. As a result, there can be achieved an effect that it is possible to provide a starter having effects similar to those of the seventh and eighth embodiments at a lower cost. Moreover, the bent interlocking rod 680 is given a lower rigidity by the spring resiliency so that it can be softly deformed against an excessive load to avoid its breakage, and has less jointed or welded portions so that it can be less troubled.

In another possible modification, the interlocking rod 680 is constructed by combining the actuating portion 680*t* and the actuated portion 680*u*. In still another possible modification, on the contrary, the interlocking rod 680 is constructed by combining the actuated portion 680*u* and the actuating portion 680*t*.

Moreover, similar effects can be achieved even if modifications corresponding mostly to the seventh embodiment are made upon the eighth embodiment.

[NINTH EMBODIMENT]

Figure 39:
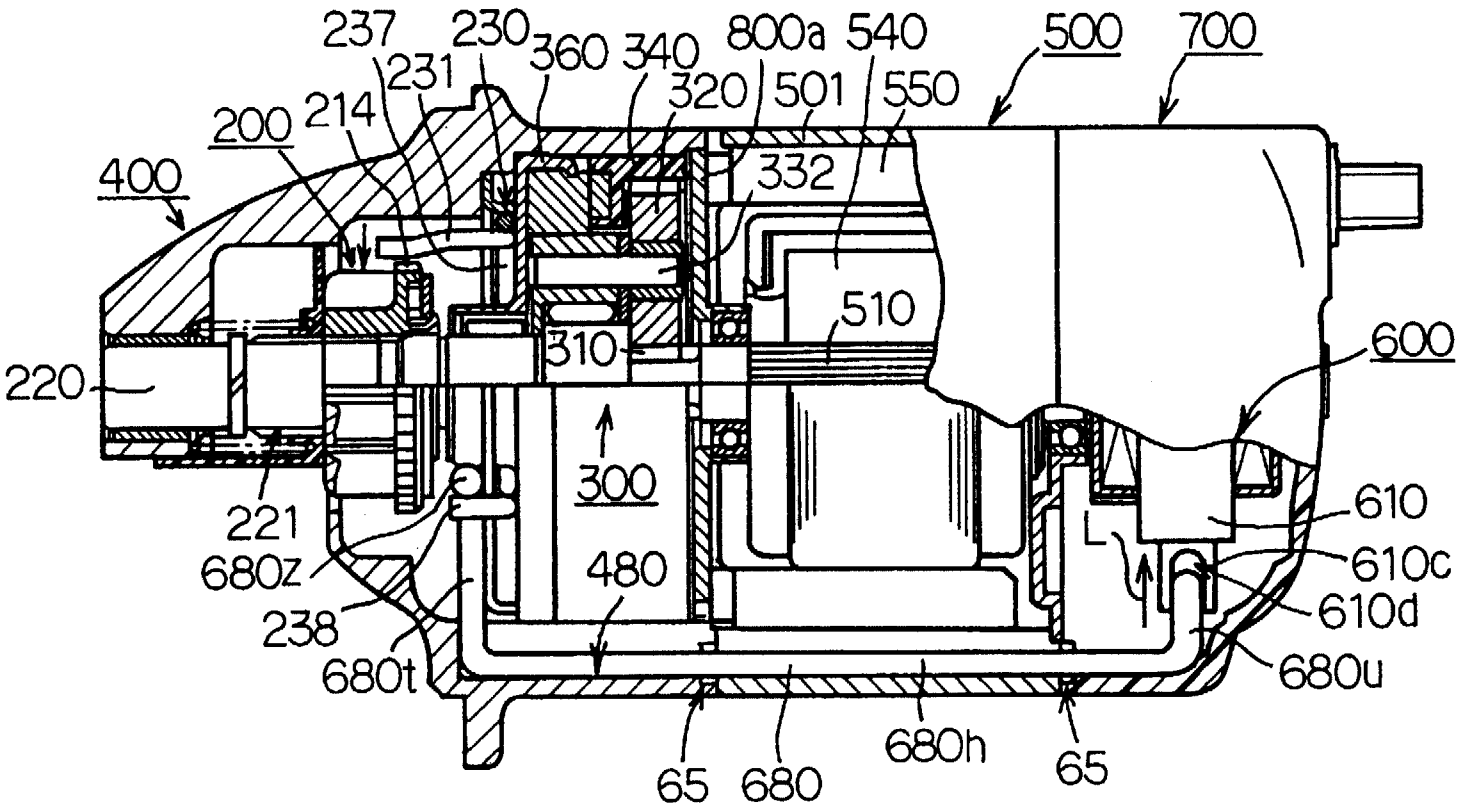
FIG. 39 is a sectional side view showing a construction of a starter according to a ninth embodiment.

A starter of a ninth embodiment is made slightly different from the seventh embodiment shown in FIG. 27. As shown in FIG. 39, the starter is provided with a planetary gear speed reduction mechanism 300 for transmitting the rotation of an armature shaft 510 at a reduced speed to the output shaft 220, and in that it is provided with a pinion rotation regulating member 230. As described in detail with regard to the first embodiment shown in FIG. 1 and the fifth embodiment shown in FIG. 19, the speed reduction mechanism 300 includes a sun gear 310, planetary gears 320 and an internal gear 340.

The present invention has been described with reference to four embodiments. However, it should not be limited to the above-described embodiments but may be modified in many ways without departing from the spirit of the invention.

What is claimed is:

1. A starter comprising:

a starter motor including field magnetic poles and an armature disposed inside the field magnetic poles;

an output shaft driven by the starter motor;

a pinion provided on the output shaft and engageable with a ring gear of an engine;

a magnet switch disposed at an axial side of the starter motor oppositely to the pinion, the magnet switch having a fixed contact and a plunger which has a movable contact that energizes the starter motor when the movable contact contacts the fixed contact by the movement of the plunger;

pinion moving means to move the pinion toward the ring gear; and a connecting member to drive the pinion moving means by the plunger of the magnet switch, wherein the connecting member extends axially through a space existing radially outside the armature.

2. A starter comprising:

a pinion moving member having a pinion engageable with a ring gear of an engine;

a motor having an armature for rotating the pinion and field magnetic poles provided radially outside the armature;

a magnet switch having a plunger and disposed oppositely to the pinion with respect to the motor for supplying an electric power from a battery to the motor;

a lever disposed turnably to move the pinion moving member toward the ring gear; and a connecting member disposed radially outside the armature and connecting the plunger of the magnet switch and the lever to turn the lever in response to an axial movement of the plunger so that the pinion moving member toward the ring gear.

3. The starter according to claim 2, wherein:

the magnet switch is deviated radially from a shaft of the armature thereby to provide a space within an axial extension of a radially outermost confine of the motor; and a battery terminal is fixed within the space to connect the magnet switch to the battery.

4. The starter according to claim 3, wherein:

the plunger is disposed axially movably; and the battery terminal is fixed to extend radially.

5. A starter comprising:

a starter motor including a generally cylindrical yoke, an armature and having an armature shaft;

an output shaft adapted to be driven by the starter motor;

a pinion mounted on the output shaft for meshing with a ring gear of an engine;

a magnet switch including a fixed contact, a movable contact to be brought into abutment against the fixed contact, a coil for generating an attraction force when energized, and a plunger to be moved by the attraction force, so that it may energize the starter motor when the movable contact is moved to abut against the fixed contact by moving the plunger;

pinion regulating means for regulating the rotation of the pinion to move the pinion toward the ring gear; and a connecting member including a moving portion to be moved by the movement of the plunger, an actuating portion for actuating the pinion regulating means, and a rotatable rod-shaped portion for connecting the moving portion and the actuating portion, the connecting member being arranged radially outside of the armature and extended generally in parallel with the armature shaft, whereby the moving portion is moved by the movement of the plunger to rotate the rod-shaped portion thereby to move the actuating portion, while abutting against the pinion regulating means, by a predetermined extent so that the pinion regulating means is actuated to regulate the rotation of the pinion thereby to move the pinion toward the ring gear.

6. The starter according to claim 5, wherein:

the magnet switch is arranged in the vicinity of the starter motor at an axially opposite side to the pinion and generally at a right angle with respect to the rotary shaft of the armature; and the rod-shaped portion of the lever is bent individually at its two axial ends so that the two bent portions provide the moving portion and the actuating portion.

7. The starter according to claim 5, further comprising:

bearings supporting rotatably the rod-shaped portion of the connecting member.

8. The starter according to claim 5, wherein:

the connecting member is resilient.

9. A starter comprising:

a starter motor including a yoke having a plurality of field magnetic poles on an inner circumference, for generating a rotating force when energized;

an output shaft arranged at one axial side of the starter motor and adapted to be rotated by the starter motor;

a movable cylindrical member including a pinion gear movable axially on the output shaft;

a magnet switch arranged at the other axial side of the starter motor; and connecting means for transmitting the drive force of the magnet switch to the pinion gear of the movable cylindrical member thereby to move the pinion gear of the movable cylindrical member toward a ring gear of an engine, wherein the connecting means is arranged through a radial outside of the yoke of the starter motor.

10. The starter according to claim 9, wherein:

the yoke has a longitudinal recess formed toward the radially inner circumference thereof and extending in the axial direction between the field magnetic poles; and the connecting means is arranged in the recess.

11. A starter comprising:

a motor including a yoke having a plurality of field magnetic poles arranged in the circumferential direction on an inner circumference thereof, and an armature rotatable and surrounded by the field magnetic poles;

an output shaft adapted to be rotated by the motor;

a pinion moving member engaging with the output shaft axially slidably and including a pinion gear capable of meshing with a ring gear of an engine;

a magnet switch including an exciting coil and a plunger adapted to be attracted by the exciting coil when the exciting coil is energized; and a rod-type connecting member including an actuated portion for engaging with the plunger, an actuating portion for moving the pinion moving member toward the ring gear, and a rod-shaped intermediate portion connecting the actuated portion and the actuating portion, wherein at least one portion of the intermediate portion of the connecting member is fitted in a groove formed axially in the inner circumference of the yoke.

12. The starter according to claim 11, further comprising:

a housing supporting the output shaft rotatably at one end portion thereof; and an end frame covering the magnet switch, wherein the housing and the end frame of the motor have respective grooves formed axially continuously with the groove formed in the yoke, and a portion of the actuating portion is fitted in the groove of the housing and a portion of the actuated portion is fitted in the groove of the rear cover.

13. The starter according to claim 11, wherein:

the magnet switch is arranged in such a direction that the plunger move generally at a right angle relative to an armature shaft of the armature;

the connecting member is supported rotatably on the axis of the intermediate portion;

the actuated portion of the interlocking rod is in engagement with the plunger at a portion radially spaced at a predetermined distance from the axis of the intermediate portion thereby to convert the movement of the plunger into a rotational motion on the axis of the intermediate portion; and the actuating portion of the connecting member has a helical front end portion having a lead in the axial direction on the axis of the intermediate portion so that the front end portion rotates on the axis of the intermediate portion to push and move the pinion moving member against which the front end portion is in abutment.

14. The starter according to claim 13, wherein:

the intermediate portion of the connecting member has at least two diametrically reduced portions having a smaller diameter than a remaining part of the intermediate portion;

the connecting member is supported by bearings fitted on the diametrically reduced portions; and each of the bearings is fixed to the inner circumference of each of the housing and the rear cover.

15. The starter according to claim 13, wherein:

the intermediate portion of the connecting member is supported on at least two portions thereof by bearings;

each of the bearings is fixed to the inner circumference of at least one of the yoke, the housing and the end frame; and a stopper ring is fixed on the intermediate portion in longitudinally adjacent to each of the bearings.

16. The starter according to claim 11, wherein:

the magnet switch is arranged in such a direction that the plunger extends generally in parallel with an armature shaft of the armature;

the connecting member so held as to move in parallel with the armature shaft; and the actuated portion is in engagement with the plunger and the actuating portion is in abutment against the pinion moving member.

17. The starter according to claim 16, wherein:

the intermediate portion is so held by holding members on at least two portions thereof as to slide in the axial direction; and each of the holding members is fixed to the inner circumference of at least one of the yoke, the housing and the rear cover.

18. The starter according to claim 11, wherein:

the connecting member is made of non-magnetic stainless steel.

19. The starter according to claim 11, further comprising:

a pinion rotation regulating member connecting to the actuating portion of the connecting member and engaging with a portion of the pinion moving member, when the actuating portion is displaced, for regulating the rotation of the pinion moving member, wherein the pinion moving member is in meshing engagement with a spline formed on the output shaft.

* * * * *

UNITED STATES PATENT AND TRADEMARK OFFICE

CERTIFICATE OF CORRECTION

PATENT NO. : 5,789,821

DATED : AUGUST 4, 1998

INVENTOR(S) : SHIGA ET AL

It is certified that error appears in the above-identified patent and that said Letters Patent is hereby corrected as shown below:

ON THE TITLE PAGE:

"[30] FOREIGN APPLICATION PRIORITY DATA

| | | | |
|---|---|---|---|
| Sep. 19, 1994 | [JP] | Japan. | . . .2-222322 |
| Feb. 14, 1996 | [JP] | Japan. | . . .8-026549 |
| Apr. 15, 1996 | [JP] | Japan. | . . .8-092095 |
| Jul. 4, 1996 | [JP] | Japan. | . . .8-174817" |

should be

--[30] FOREIGN APPLICATION PRIORITY DATA

| | | | |
|---|---|---|---|
| Sep. 19, 1994 | [JP] | Japan. | . . .6-222322 |
| Jan. 1, 1996 | [JP] | Japan. | . . .8-7880 |
| Feb. 14, 1996 | [JP] | Japan. | . . .8-026549 |
| Apr. 15, 1996 | [JP] | Japan. | . . .8-092095 |
| Jul. 4, 1996 | [JP] | Japan. | . . .8-174817-- |

Signed and Sealed this

Fifth Day of January, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,789,821
DATED : August 4, 1998
INVENTOR(S) : SHIGA, et al

It is certified that error appears in the above-identified patent and that said Letters Patent is hereby corrected as shown below:

ON THE TITLE PAGE:

```
"[30] FOREIGN APPLICATION PRIORITY DATA
     Sep. 19, 1994    [JP]  Japan. . . .2-222322
     Feb. 14, 1996    [JP]  Japan. . . .8-026549
     Apr. 15, 1996    [JP]  Japan. . . .8-092095
     Jul.  4, 1996    [JP]  Japan. . . .8-174817"

          should be

--[30] FOREIGN APPLICATION PRIORITY DATA
     Sep. 19, 1994    [JP]  Japan. . . .6-222322
     Feb. 14, 1996    [JP]  Japan. . . .8-026549
     Apr. 15, 1996    [JP]  Japan. . . .8-092095
     Jul.  4, 1996    [JP]  Japan. . . .8-174817--
```

This certificate supersedes Certificate of Correction issued January 5, 1999.

Signed and Sealed this

Fourth Day of April, 2000

*Attest:*

Q. TODD DICKINSON

*Attesting Officer*

*Director of Patents and Trademarks*